US006180312B1

(12) United States Patent
Edwards

(10) Patent No.: US 6,180,312 B1
(45) Date of Patent: Jan. 30, 2001

(54) PHOTOGRAPHIC IMAGING SYSTEM INCORPORATING METADATA RECORDING CAPABILITY

(75) Inventor: James L. Edwards, Rochester, NY (US)

(73) Assignee: Eastman Kodak Company, Rochester, NY (US)

( * ) Notice: Under 35 U.S.C. 154(b), the term of this patent shall be extended for 0 days.

(21) Appl. No.: 09/532,928

(22) Filed: Mar. 22, 2000

(51) Int. Cl.[7] ..... G03C 1/46
(52) U.S. Cl. ..... 430/140; 430/503
(58) Field of Search ..... 430/140, 503

(56) References Cited

U.S. PATENT DOCUMENTS

| | | | |
|---|---|---|---|
| 4,178,183 | 12/1979 | Ciurca, Jr. et al. | 430/553 |
| 4,208,210 | 6/1980 | Sakai et al. | 430/140 |
| 4,233,389 | 11/1980 | Fernandez et al. | 430/140 |
| 4,816,378 | 3/1989 | Powers et al. | 430/301 |
| 5,108,882 | 4/1992 | Parton et al. | 430/502 |
| 5,313,235 | 5/1994 | Inoue et al. | 354/76 |
| 5,629,512 | 5/1997 | Haga | 235/468 |
| 5,664,557 | 9/1997 | Makiej, Jr. | 128/200.23 |
| 5,774,752 | 6/1998 | Patton et al. | 396/312 |
| 5,842,063 | 11/1998 | Hawkins et al. | 396/315 |

FOREIGN PATENT DOCUMENTS 0 915 374 A1 5/1999 (EP) .

*Primary Examiner*—Hoa Van Le
(74) *Attorney, Agent, or Firm*—Paul A. Leipold

(57) ABSTRACT

The invention relates to a color negative photographic element comprising a support, upon which is coated a blue sensitive silver halide layer containing a yellow dye forming coupler, a green sensitive silver halide layer containing a magenta dye forming coupler, a red sensitive silver halide layer containing a cyan dye forming coupler, and a $4^{th}$ sensitized layer containing an infrared dye forming coupler and wherein the dye formed by the infrared dye forming coupler has a λ-max greater than 680 nm and wherein the density of the absorption band of the characteristic vector of the cyan dye, normalized to 1.0 density, is less than 0.4 at 700 nm.

21 Claims, 2 Drawing Sheets

PHOTOGRAPHIC IMAGING SYSTEM INCORPORATING METADATA RECORDING CAPABILITY

FIELD OF THE INVENTION

This invention relates to silver halide photographic systems and methods for incorporating and recovering metadata, such as sound data, into a photographic image and is specifically concerned with the incorporation of non-visually perceptible sound information into a photograph.

BACKGROUND OF THE INVENTION

With the advent of digital printing capability in silver halide systems, the ability to combine information such as text, numbers, or other information, to color photographs has become possible. The use of computers and sophisticated computer software make it possible to combine digital image data originating from sources such as a digital camera, a computer image or from a silver halide film or paper, which had been electronically scanned, with additional information, then send the combined encoded data to a digital film or paper writer to produce a photograph.

The conversion of non-image wise information such as text, numbers or other graphics, commonly known as metadata, to digital information is well known in many industries. Converting analogue sound information to a digital data is also well known, and many digital still cameras and all video-recording cameras have this feature. The desire to include sound information with pictures has long been a goal. In video cameras, sound is captured with the image on videotape and replayed through a television. In still cameras, the ability to record sound exists, but the capability to embed the sound information along with the pictorial information has been elusive despite several strategies.

Akamine et al in U.S. Pat. No. 5,664,557 has disclosed a system for recording and reproducing sound as a visible 2-dimensional bar code using a thermal printer. The recorded sound can be printed onto a label and then affixed to an object such as a photograph and subsequently scanned with a bar code reader by the viewer. The reader reinterprets the bar code as sound data and then plays the sound through a speaker. The difficulty with this system is that the sound image and the pictorial image are spatially and temporally separate. In addition, if the label is affixed to the back of the image, the viewer cannot conveniently place the image in an album where it would first have to be removed in order to be interpreted. If the label is affixed to the image itself, it detracts from the image and if affixed to the album, requires its own space in the album and detracts from the aesthetic quality of the album. Hence, it is clearly more desirable for the picture to have the sound associated with it, but in an invisible way so that it not detract from the quality of the picture or album or inconvenience the viewer in any other way.

The ability to include sound information and image information has been demonstrated in the motion picture industry with the integral sound track technology. The sound track is comprised of a spatially separate ribbon of developed silver placed along side the frame containing the image. The silver sound image remains in the film by a unique step in the processing cycle so that it is not removed with the silver used to form the image. The 'sound' file is written onto the film in a separate exposing step using a sound negative. The 'sound' information is read from the print film by using an infrared sensor to measure the modulation of the silver image as a function of density and time. To achieve high fidelity sound images, a large range of developed silver density is required.

Because of the added complexity to the processing chemistry and the number of additional steps required to include the sound track, other strategies have evolved to overcome these problems. One such strategy has been described by Ciurca et al in U.S. Pat. No. 4,178,183 and improved upon by Fernandez et al in U.S. Pat. No. 4,233,389. These inventions replace the silver sound track with one comprised of an infrared light absorbing dye. The coupler which forms the dye is coated in the film in a $4^{th}$ sensitized layer, and after exposure and development forms an infrared dye whose density is proportional to the sound signal from the sound negative. Modulation of this $4^{th}$ infrared dye forming layer then produces a response similar to that of a developed silver sound track, but does not require special processing of the print film. Much like the silver sound track image, to reproduce a high fidelity sound, a wide dynamic range of infrared density is required and as a result, infrared dye densities of at least 3.0 are required in order to obtain hi-fidelity sound quality.

Hawkins et al in U.S. Pat. No. 5,842,063 teaches that the dye produced by the coupler in the layer sensitized to record non-imagewise information should absorb in the regions of the spectrum not appreciably overlapping with the regions of absorption of the other color records in order that the developed record of the digital data not interfere with the viewing of the pictorial records. To accomplish this, he proposes the use of infrared dye forming couplers coated onto the imaging element in an additional layer to the imaging records. However, he does not suggest any preferred compositions, Due to the inherent chemical nature of organic dyes, formed in chromogenic reactions with para-phenylenediamine type color developers, the spectral absorption bands are often broader than desired. In color negative films, the unwanted absorptions of the dyes are compensated for by the colored coupler masking dyes and by additional chemistry in the film called inter-image chemistry such as development inhibitor releasing (DIR) chemistry. In the case of couplers that form infrared dyes, their chemical compositions can be such that a variety of dyes having different $\lambda$-maxs, or peak absorptions, are known.

The unwanted adsorptions of the high density of the infrared dye required to produce an adequate signal to noise ratio in the motion picture print film is not an issue when the sound track and the image are spatially distinct. However, since it is desirable to have the sound image and the pictorial image in the same spatial area of the print, then the so-called unwanted absorptions of the infrared image dye must be minimized so that they do not contribute non-imagewise information to the picture.

It is, therefore, highly desirable to design a system wherein the photographic element has the ability to record metadata such as sound or other information in the same spatial area as the imagery with an 'invisible dye' so that the metadata information does not degrade the pictorial quality of the image and is co-optimized with the design of the sensor which reads the invisibly encoded metadata image.

Prior Art:

Ciurca et al in U.S. Pat. No. 4,178,183 discloses a photographic element useful for forming integral soundtracks, particularly for motion picture print films, by incorporating micro-crystalline infrared absorbing dyes in a $4^{th}$ sensitized layer.

Fernandez et al in U.S. Pat. No. 4,233,389 discloses a photographic element useful for forming integral soundtracks, particularly for motion picture print films, by incorporating micro-crystalline infrared absorbing dyes in a $4^{th}$ sensitized layer.

Sakai et al in U.S. Pat. No. 4,208,210 discloses a photographic element useful for forming integral soundtracks, particularly for motion picture print films, by incorporating infrared absorbing dyes in a $4^{th}$ sensitized layer wherein the $4^{th}$ sensitized layer is sensitive to the ultraviolet light.

Powers et al in U.S. Pat. No. 4,816,378 discloses an imaging process and photographic element useful for forming half-tone color proof images by incorporating a $4^{th}$ sensitized layer which contains a black or infrared dye.

Hawkins et al in U.S. Pat. No. 5,842,063 discloses a camera, film and method for recording overlapping visual and digital images in the same region of the film.

Soscia et al in U.S. application Ser. No. 09/099,616 filed Jun. 18, 1998, discloses a method and apparatus for reading invisibly printed sound data on an object, the invisible sound data being imprinted by an invisible dye from a thermal dye transfer process, an invisible printing ink, or a special photographic printing paper containing an infrared absorbing layer.

Soscia et al in U.S. application Ser. No. 09/099,627 filed Jun. 18, 1998, discloses a system and apparatus for printing invisible sound data on an object the sound data component being comprised of an infiared dye, the invisible sound data being imprinted by an invisible dye from a thermal dye transfer process.

Haraga et al in European Patent Application EP 0 915 374 A1 describes an imaging method comprising a photographic element containing a $4^{th}$ sensitized layer which is designed to add invisible image information to an image.

Patton et al in U.S. Pat. No. 5,774,752 describes a method for processing photographic still images having sound information associated with them.

Akamine et al in U.S. Pat. No. 5,664,557 describes an audio data recording/reproduction system for printing optically readable code on photographic paper as a visible image.

Haga in U.S. Pat. No. 5,629,512 describes an information reading apparatus for reading invisible information encoded in an underlying layer of a recording medium which fluoresces upon being exposed to light of a specific wavelength.

Parton et al in U.S. Pat. No. 5,108,882 describes a photographic element having at least one photographic emulsion layer which is sensitized to infrared light.

Inoue et al in U.S. Pat. No. 5,313,235 describes a sound playback apparatus capable of decoding magnetically encoded sound information which has been previously encoded into an image recording medium such as a photograph.

PROBLEM TO BE SOLVED BY THE INVENTION

There is a need to record metadata in a photographic image.

SUMMARY OF THE INVENTION

One object of the invention is to provide a novel photographic element capable of recording metadata in a way that the quality of the pictorial image is not diminished.

Another object of the invention is to provide the novel process of combining metadata information, such as sound, with pictorial information.

Another object of the invention is to provide a photographic element, which requires no special processing to produce the metadata or sound image.

These objects are accomplished by a photographic element which contains at least a first silver halide layer containing a yellow dye forming coupler, a second silver halide layer containing a magenta dye forming coupler, a third silver halide layer containing a cyan dye forming coupler, and a fourth silver halide layer containing an infrared dye forming coupler, wherein the characteristic vector of the cyan dye normalized to a density of 1.0 has a density of less than 0.4 at 700 nm, more preferably less than 0.35 and most preferably less than 0.2.

ADVANTAGEOUS EFFECT OF THE INVENTION

Figure 1:
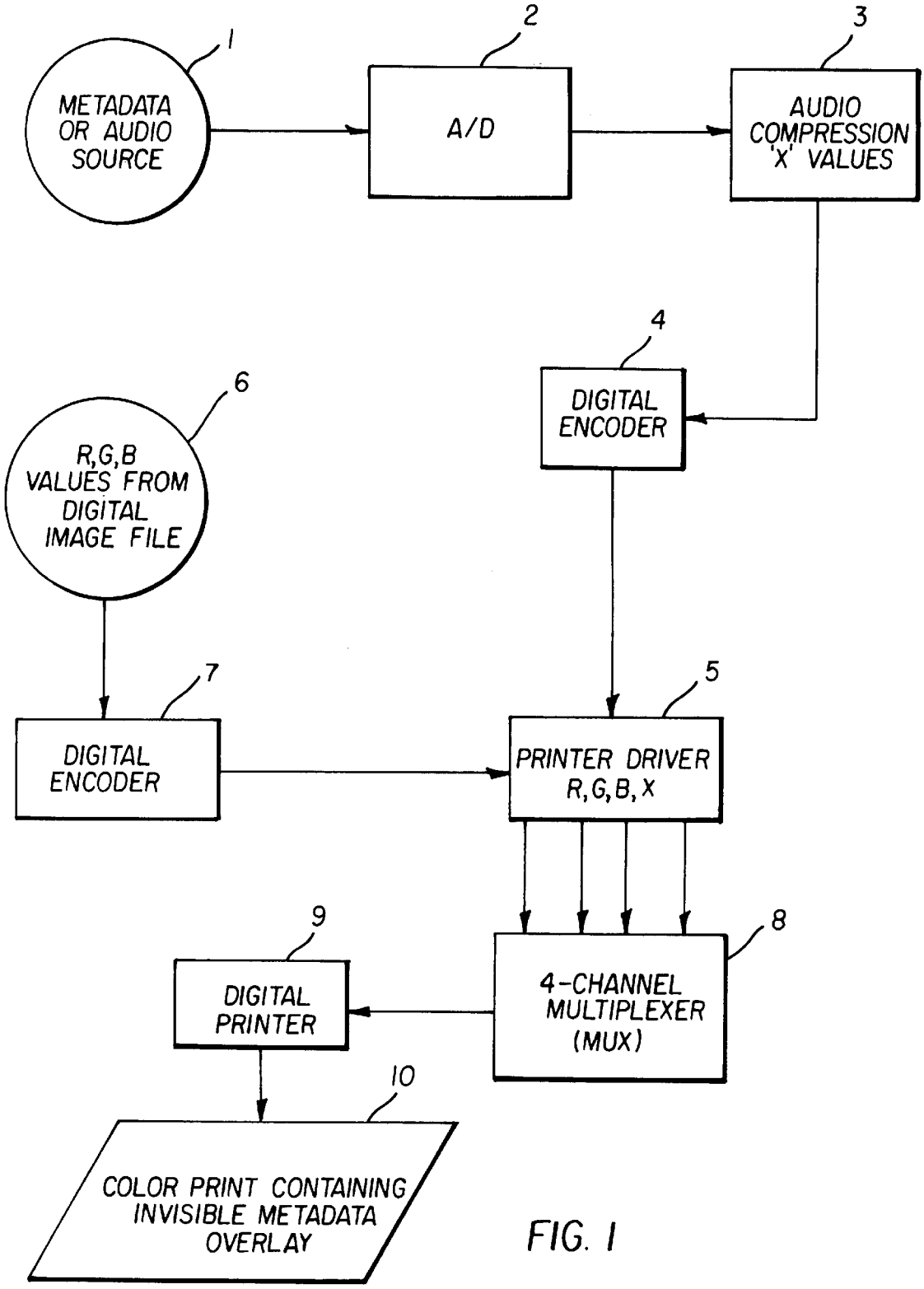
FIG. 1 is a schematic diagram showing how a source of metadata, such as an audio signal, is converted to a digital signal, encoded, passed to a 4-color film/paper writer in combination with the R,G,B values from a pictorial image file, multiplexed, then printed as an invisible image onto a color photograph.

The invention provides a system for incorporating metadata in a photographic element.

DETAILED DESCRIPTION OF THE INVENTION

The invention provides a photographic system, including a 4-channel digital film writer, a false sensitized photographic element capable of being digitally exposed and which provides a $4^{th}$ sensitized layer to record invisible metadata information, such as sound, a hand-held metadata reader which senses the invisible metadata image in the element, decodes the metadata information, and reproduces the digital signal as sound or other information.

The term 'metadata', as used herein, refers to any information separate and apart from the actual image of the picture seen by the end user. As such, metadata may be text, numbers, or other coded information, including audio, binary, digital or graphic information which, when encoded and included with the image, adds information to the image without adding to or subtracting from image content. Metadata, in general, may be visible or invisible. In this application, the metadata information is spatially coincident with the image information, it is preferred to be invisible, either by its lack of color or by its image size (i.e., too small to see). Examples of metadata are the UPC codes currently used to encode the price and other information about wholesale or food goods, product code numbers used to track inventory, e-stamps used for digital postage, etc. In other photographic applications, metadata may include the date of film printing and processing, information regarding the type of film negative, the color correction codes used in printing, the name of the photofinisher, etc.

The system and process for perceptibly integrating sound information onto film, a label, or other hard object is described in detail in U.S. Pat. Nos. 5,644,557; 5,313,235; 5,774,752 and for incorporating non-perceptible information onto film or reflective print pictures in U.S. Pat. Nos.

4,208,210; 5,629,512; 5,919,730 and U.S. application Ser. Nos. 09/099,627 and 09/099,616.

The design of this system requires the definition of the response characteristics of the various elements of the system. Each element plays a crucial role in the design. This is not to say that various substitutions could not be made for elements such as the response of a sensor or filter or illuminant. It is to say only that to define the requirements of a system, each element be well characterized so that its characteristic response is known.

The elements of the system which need to be specified are:

1. The design of the four-color record film or paper writer used to write the pictorial and metadata information onto the photographic element, the design of which includes the selection of the four light sources and their respective power distributions as a function of wavelength, to match the spectral sensitivities of the element.
2. The composition of the photographic element, which records the pictorial as well as the metadata or sound information. Within these layers, the absorption spectra of the imaging couplers, the absorption spectra of the invisible dye, and for capturing purposes, the spectral sensitivities of each of the layers.
3. The design of the metadata reading sensor. This includes the quantum efficiency response of the sensor as a fimction of wavelength, the illuminant and illumination used to illuminate the invisible metadata contained within the pictorial image, while the metadata signal is measured as a function of wavelength and the spectral distribution of any additional filters used in combination with the sensor to flirther enhance the signal to noise (S/N) ratio of the system.

Design requirements to achieve the performance of the integrated system:

1. Digital Film/Paper Writer for Metadata Encoding

The schematic diagram in FIG. 1 depicts the collection, encoding, and writing of the metadata and image information onto a four-color false sensitized color photograph. The metadata, or sound file (1), such as that captured and stored by many digital film cameras today, is first digitized (2) (if necessary). Since a 10-second sound bite may convert to a digital file of perhaps 400 k-bytes or larger, it is desirable to compress the file to a smaller size. Many software algorithms are available that accomplish audio compression (3), such as that from Digital Voice Systems, Inc., AMBE-1000 Voice Coder.

After compression, the data file may be further encoded (4) for printing in a digital file format known as "Paper Disk". This encoding software is available from Cobblestone Software, Inc., in Lexington, Mass.

On a parallel path, as shown in FIG. 1, is the image information from the original pictorial scene, which may have been captured on film or in a digital camera. If the original image was made on film, the image must first be scanned in a film or paper scanner to record the R,G,B values as a function of pixel position in the image. This process creates a spatial array of R,G,B values proportional to the amounts of red, green, and blue light in the original scene and stores them as a function of pixel position (6). A common digital picture storage file format is called JPEG (jpg).

This digital image file is then read and re-encoded (7) in a format compatible with the digital printer. This information is subsequently transmitted to the printer driver engine (5) where it is combined with the encoded metadata sound file then the 4-channel R,G,B,X file, where the X-channel represents the metadata channel, is read and the code values are sent to the 4-channel multiplexer (8) of the digital printer.

The multiplexer (8) drives the 4color digital printer (9). This printer contains the four light sources that have been matched to the spectral sensitivities of the output writing media (10), a color paper, for example. The printer is driven to scan pixel by pixel across the media, and the four different light sources are modulated in proportion the different amounts of light necessary to expose the R,G,B pictorial image and the X-metadata image. In principle, this process could be accomplished in two separate steps. The first in writing the pictorial information and the second writing the metadata information, but in practice, it is more efficient to have the signals combined and write all four simultaneously.

There are numerous commercially available digital printers in the market place. Their design generally is based upon the type of illuminant source chosen to expose the media. Illuminant sources have generally fallen into four categories: Lasers, laser diodes, light emitting diodes (LED's), or cathode ray tubes (CRT's). LED's as the choice of light source are commercially available over a wide range of wavelengths, are compact, and their power output is stable and easy to regulate. A representative sampling of LED's is given below:

| Manufacturer | Type/Model | Output Wavelength |
|---|---|---|
| Siemens Corp. | GaN, LB5416 | 430 nm |
| Nichia Chemical Industries Ltd. | GaN, NSPB-WR | 470 nm |
| Nichia Chemical Industries Ltd. | GaN, NSPG-Rank-H | 526 nm |
| Hewlett-Packard | HLMP-GJ10 | 621 nm |
| Hewlett-Packard | HLMP-GL10 | 635 nm |
| Marktech Co. | MT5000F-UR | 695 nm |

The digital printer light sources are preferably unique sources and different in their spectral output by approximately 50 nm. It is also useful to have the printer sources be narrowly collimated so that the output wavelengths are singularly unique and as closely matched to the spectral sensitivities of the four-color paper as possible. The printer electronics drive the location of the exposing bean of mixed, modulated light across the media. This is frequently accomplished by exposing the beam onto a rapidly rotating polygon whose facets are aligned with the media. Preferred light sources are lasers, laser diodes, and LED's due to their narrow output bandwidth and their ability to be modulated at high frequency. Combinations of different types of light sources are also acceptable.

2. Design of the Photographic Element

The system comprises the photographic element containing an additional imaging layer, other than the R, G, B layers already present in all color systems. This layer can be exposed with light of some predetermined wavelength in a digital printer whose wavelength corresponds to the spectral sensitivity of the emulsion that is coated within said $4^{th}$ sensitized layer. The spectral sensitivity of this layer is unique compared to the spectral sensitivities of the imaging layers so that when the exposure is made onto the element which will record the metadata, the layers containing the imaging chemistry to produce the pictorial image are not in any way exposed or compromised. This is typically accomplished by choosing an exposing light source which is approximately 50 nm different in wavelength from the other exposing light sources and modulating the power level of this light source so as not to expose the pictorial imaging records. Thus in addition to the red, green and blue exposures given the element to produce the pictorial information, an additional $4^{th}$ exposure is made which contains the metadata information.

In this invention, since the pictorial portion of the photographic element has spectral sensitivities in the blue region at about 473nm, in the green region at about 550 nm and in the red region at about 695 nm, the $4^{th}$ sensitized layer could be designed to be exposed at one any of several locations. One opportunity is to place the spectral sensitization in the near infrared region, or somewhat past 700 nm, more preferably past 750 nm so as not to confuse the response of this layer with the red sensitive layer. Digital exposing devices are readily available at a variety of wavelengths that have sufficient power output and a narrow wavelength of power distribution to meet this requirement. Many such devices are already used in the health imaging field to expose digital x-ray, MRI, CAT, or other films used by this industry.

| Writing Channel | Spectral Sensitivity |
|---|---|
| Red | 695 nm |
| Green | 550 nm |
| Blue | 473 nm |
| X | 430 nm |
| Or X | 625 nm |
| Or X | 765 nm |
| Or X | 820 nm |

A typical multicolor photographic element comprises a support bearing a cyan dye image forming layer comprised of at least one red light sensitive silver halide emulsion having associated therewith at least one cyan dye-forming coupler, a magenta dye image forming layer comprising at least one green light sensitive silver halide emulsion having associated therewith at least one magenta dye-forming coupler, and a yellow dye image forming layer comprising at least one blue-sensitive silver halide emulsion having associated therewith at least one yellow dye-forming coupler. The element can contain additional layers, such as filter layers, interlayers, overcoat layers, subbing layers, and the like.

In the following discussion of suitable materials for use in the emulsions and elements that can be used in conjunction with this invention, reference will be made to *Research Disclosure*, September 1994, Item 36544, published by Kenneth Mason Publications, Ltd., Dudley House, 12 North Street, Emsworth, Hampshire PO10 7DQ, England, which will be identified hereafter by the term "*Research Disclosure.*"

The silver halide emulsions employed in these photographic elements can be either negative-working or positive-working. Suitable emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing can be found in Sections XI–XX.

Further, it would be advantageous to practice elements of the invention in conjunction with the materials disclosed in an article entitled "Typical and Preferred Color Paper, Color Negative, and Color Reversal Photographic Elements and Processing" which was published in *Research Disclosure*, February 1995, Volume 370. In particular, Sections I–XIII, XV–XVIII, and XXIIIA are especially relevant.

Any photographic coupler known to the art can be used in conjunction with elements of the invention. Suitable couplers are described in Research Disclosure, Item 36544, Section X. In addition, the structures of particularly preferred couplers can be found in an article entitled "Typical and Preferred Color Paper, Color Negative, and Color Reversal Photographic Elements and Processing" which was published in *Research Disclosure*, February 1995, Volume 370, Section II.

An example of a cyan dye forming coupler of the invention is one having Formula (I):

(I)

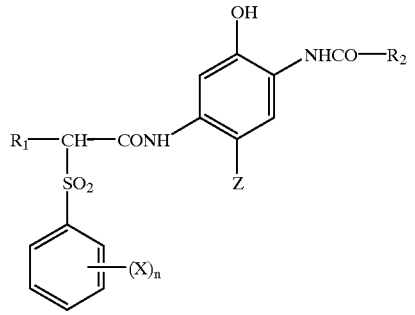

wherein $R_1$ represents hydrogen or an alkyl group;

$R_2$ represents an alkyl group or an aryl group;

n represents 1, 2, or 3;

each X is located at a position of the phenyl ring meta or para to the sulfonyl group and is independently selected from the group consisting of alkyl, alkenyl, alkoxy, aryloxy, acyloxy, acylamino, sulfonyloxy, sulfamoylamino, sulfonamido, ureido, oxycarbonyl, oxycarbonylamino, and carbamoyl groups; and Z represents a hydrogen atom or a group which can be split off by the reaction of the coupler with an oxidized color developing agent.

Coupler (1) is a 2,5-diacylaminophenol cyan coupler in which the 5-acylamino moiety is an amide of a carboxylic acid which is substituted in the alpha position by a particular sulfone (—$SO_2$—) group. The sulfone moiety must be an arylsulfone and cannot be an alkylsulfone, and must be substituted only at the meta or para position of the aryl ring. In addition, the 2-acylamino moiety must be an amide (—NHCO—) of a carboxylic acid, and cannot be a ureido (—NHCONH—) group. The result of this unique combination of sulfone-containing amide group at the 5-position and amide group at the 2-position is a class of cyan dye-forming couplers which form H-aggregated image dyes having very sharp-cutting dye hues on the short wavelength side of the absorption curves and absorption maxima (λmax) generally in the range of 620–645 nanometers, which is ideally suited for producing excellent color reproduction and high color saturation in color photographic papers.

Referring to formula (1), $R_1$ represents hydrogen or an alkyl group including linear or branched cyclic or acyclic alkyl group of 1 to 10 carbon atoms, suitably a methyl, ethyl, n-propyl, isopropyl or butyl group, and most suitably an ethyl group.

$R_2$ represents an aryl group or an alkyl group such as a perfluoroalkyl group. Such alkyl groups typically have 1 to 20 carbon atoms, usually 1 to 4 carbon atoms, and include groups such as methyl, propyl and dodecyl, a perfluoroalkyl group having 1 to 20 carbon atoms, typically 3 to 8 carbon atoms, such as trifluoromethyl or perfluorotetradecyl, heptafluoropropyl or heptadecylfluorooctyl; a substituted or unsubstituted aryl group typically having 6 to 30 carbon atoms, which may be substituted by, for example, 1 to 4 halogen atoms, a cyano group, a carbonyl group, a carbonarnido group, a sulfonamido group, a carboxy group, a sulfo group, an alkyl group, an aryl group, an alkoxy group, an aryloxy group, an alkylthio group, an arylthio group, an alkylsulfonyl group or an arylsulfonyl group. Suitably, $R_2$ represents a heptafluoropropyl group, a 4-chlorophenyl group, a 3,4-dichlorophenyl group, a 4-cyanophenyl group, a 3-chloro-4-cyanophenyl group, a pentafluorophenyl group, a 4-carbonamidophenyl group, a 4-sulfonamidophenyl group, or an alkylsulfonylphenyl group.

In formula (I), each X is located at the meta or para position of the phenyl ring, and each independently represents a linear or branched, saturated or unsaturated alkyl or alkenyl group such as methyl, t-butyl, dodecyl, pentadecyl or octadecyl; an alkoxy group such as methoxy, t-butoxy or tetradecyloxy; an aryloxy group such as phenoxy, 4-t-butylphenoxy or 4-dodecylphenoxy; an alkyl or aryl acyloxy group such as acetoxy or dodecanoyloxy; an alkyl or aryl acylamino group such as acetamido, benzamido, or hexadecanamido; an alkyl or aryl sulfonyloxy group such as methylsulfonyloxy, dodecylsulfonyloxy, or 4-methylphenylsulfonyloxy; an alkyl or aryl sulfamoylamino group such as N-butylsulfamoylamino, or N-4-t-butylphenylsulfamoylamino; an alkyl or aryl sulfonamido group such as methanesulfonamido, 4-chlorophenylsulfonarnido or hexadecanesulfonamido; a ureido group such as methylureido or phenylureido; an alkoxycarbonyl or aryloxycarbonylamino group such as methoxycarbonylamino or phenoxycarbonylamo; a carbamoyl group such as N-butylcarbamoyl or N-methyl-N-dodecylcarbamoyl; or a perfluoroalkyl group such as trifluoromethyl or heptafluoropropyl. Suitably X represents the above groups having 1 to 30 carbon atoms, more preferably 8 to 20 linear carbon atoms. Most typically, X represents a linear alkyl group of 12 to 18 carbon atoms such as dodecyl, pentadecyl or octadecyl.

"n" represents 1, 2, or 3; if n is 2 or 3, then the substituents X may be the same or different.

Z represents a hydrogen atom or a group which can be split off by the reaction of the coupler with an oxidized color developing agent, known in the photographic art as a "coupling-off group". The presence or absence of such groups determines the chemical equivalency of the coupler, i.e., whether it is a 2-equivalent or 4-equivalent coupler, and its particular identity can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction, and the like.

Representative classes of such coupling-off groups include, for example, halogen, alkoxy, aryloxy, heterocyclyloxy, sulfonyloxy, acyloxy, acyl, heterocyclyl, sulfonamido, heterocyclylthio, benzothiazolyl, phosophonyloxy, alkylthio, arylthio, and arylazo. These coupling-off groups are described in the art, for example, in U.S. Pat. Nos. 2,455,169; 3,227,551; 3,432,521; 3,467,563; 3,617,291; 3,880,661; 4,052,212; and 4,134,766; and in U.K. Patent Nos. and published applications 1,466,728; 1,531,927; 1,533,039; 2,066,755A; and 2,017,704A. Halogen, alkoxy and aryloxy groups are most suitable.

Examples of specific coupling-off groups are —Cl, —F, —Br, —SCN, $—OCH_3$, $—OC_6H_5$, $—OCH_2C(=O)NHCH_2CH_2OH$, $—OCH_2C(O)NHCH_2CH_2OCH_3$, $—OCH_2C(O)NHCH_2CH_2OC(=O)OCH_3$, $—P(=O)(OC_2H_5)_2$, $—SCH_2CH_2COOH$,

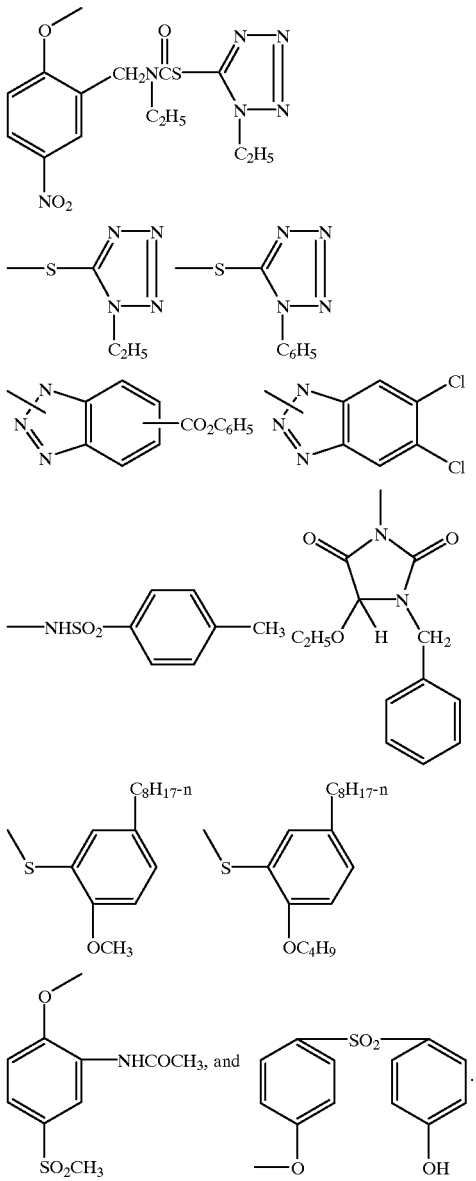

Typically, the coupling-off group is a chlorine atom.

It is essential that the substituent groups Rhd 1, $R_2$, X, and Z be selected so as to adequately ballast the coupler and the resulting dye in the organic solvent in which the coupler is dispersed. The ballasting may be accomplished by providing hydrophobic substituent groups in one or more of the substituent groups $R_1$, $R_2$, X, and Z. Generally a ballast group is an organic radical of such size and configuration as to confer on the coupler molecule sufficient bulk and aqueous insolubility as to render the coupler substantially non-diffusible from the layer in which it is coated in a photographic element. Thus the combination of substituent groups $R_1$, $R_2$, X, and Z in formula (I) are suitably chosen to meet these criteria. To be effective, the ballast must contain at least 8 carbon atoms and typically contains 10 to 30 carbon atoms. Suitable ballasting may also be accomplished by providing a plurality of groups which in combination meet these criteria. In the preferred embodiments of the invention $R_1$ in formula (1) is a small alkyl group. Therefore, in these embodiments the ballast would be primarily located as part of groups $R_2$, X, and Z. Furthermore, even if the coupling-off group Z contains a ballast, it is often necessary to ballast the other substituents as well, since Z is eliminated from the molecule upon coupling; thus, the ballast is most advantageously provided as part of groups $R_2$ and X.

The following examples firlher illustrate the invention. It is not to be construed that the present invention is limited to these examples.

IC-1

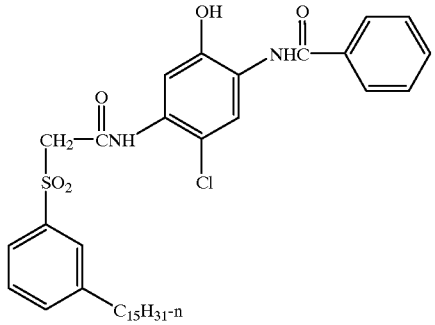

IC-2

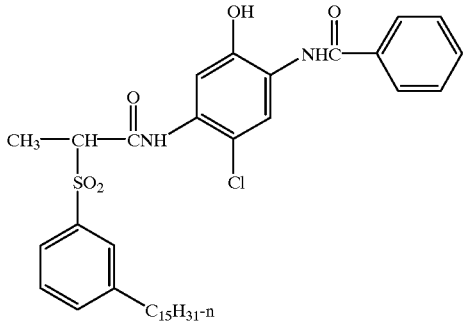

IC-3

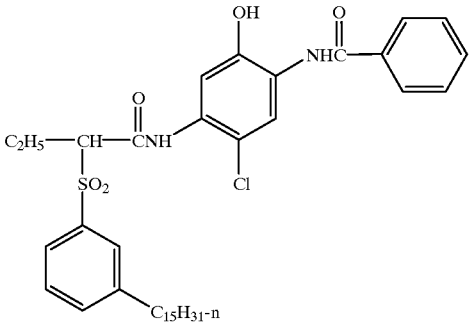

IC-4

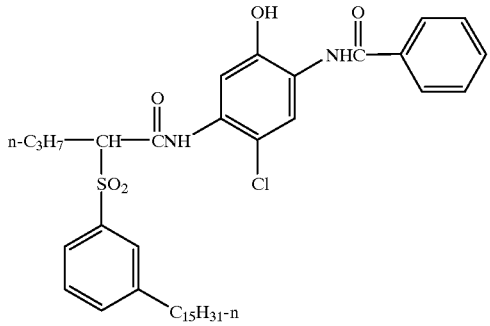

IC-5

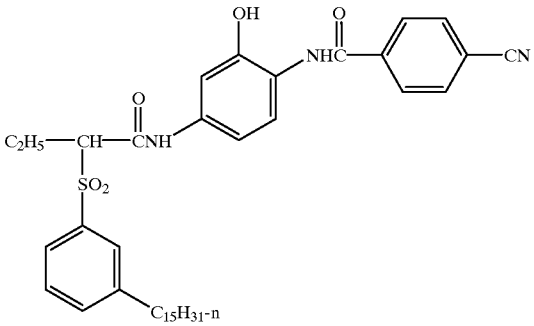

IC-6

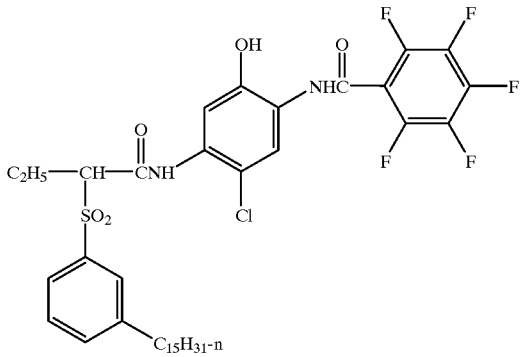

IC-7

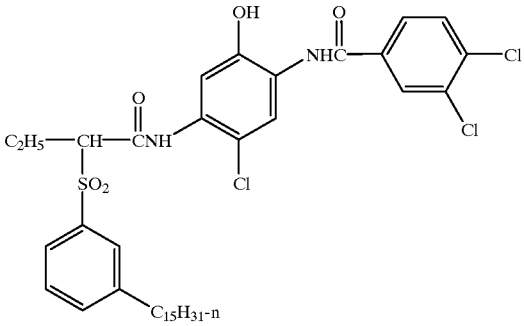

IC-8

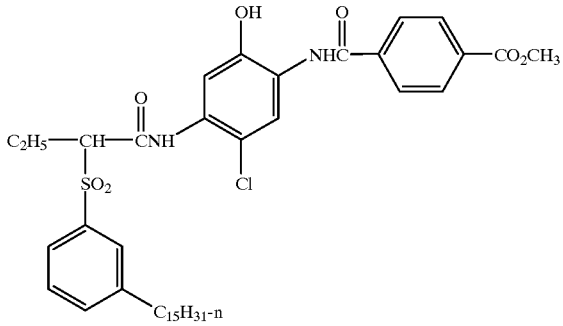

-continued
IC-9
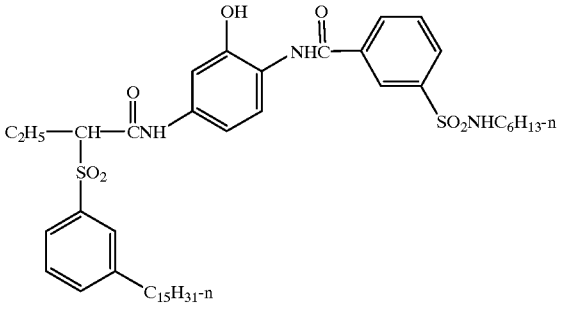
IC-10
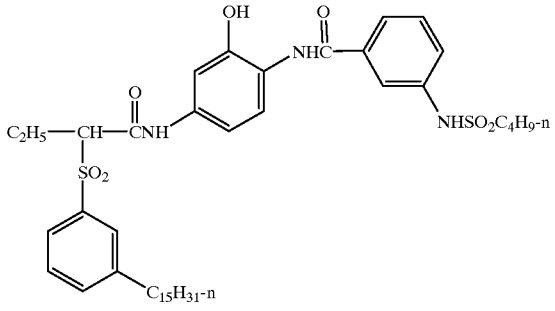
IC-11
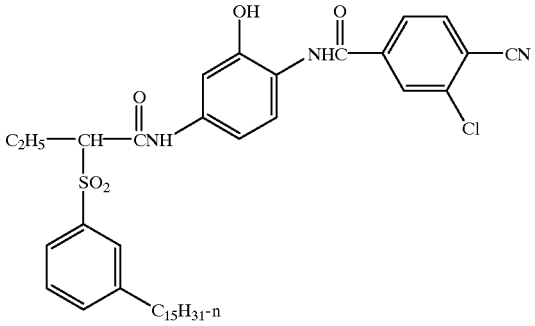
IC-12
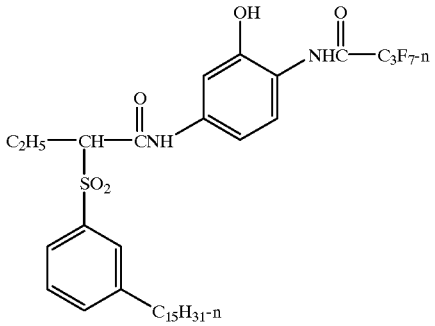
IC-13
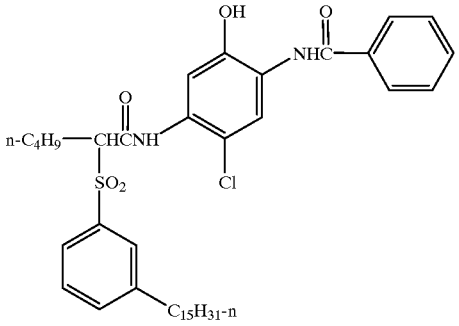
IC-14
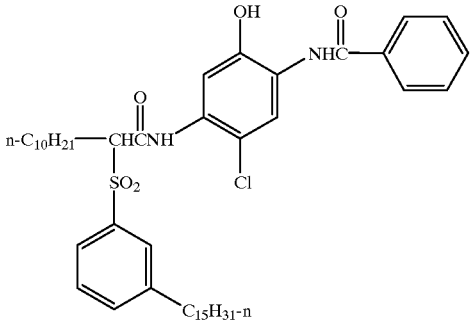
IC-15
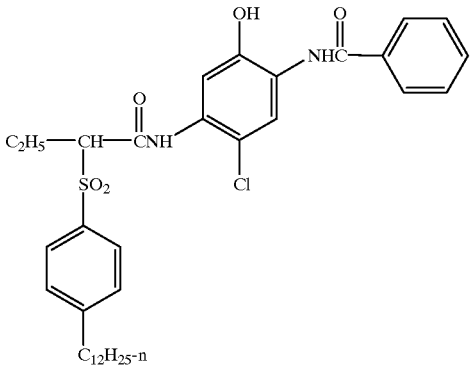
IC-16
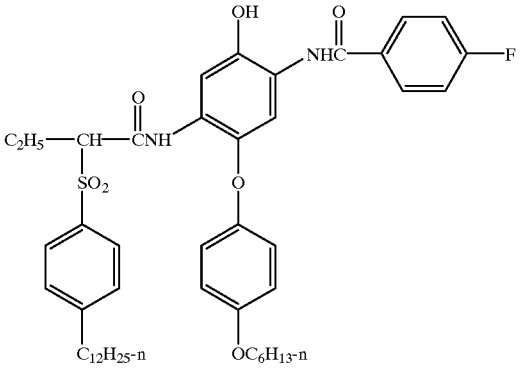

-continued
IC-17
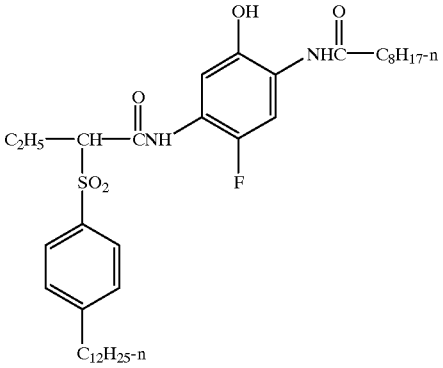
IC-18
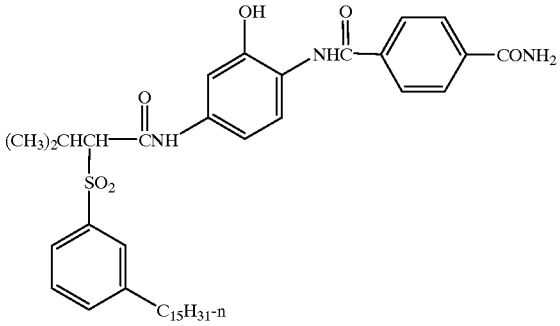
IC-19
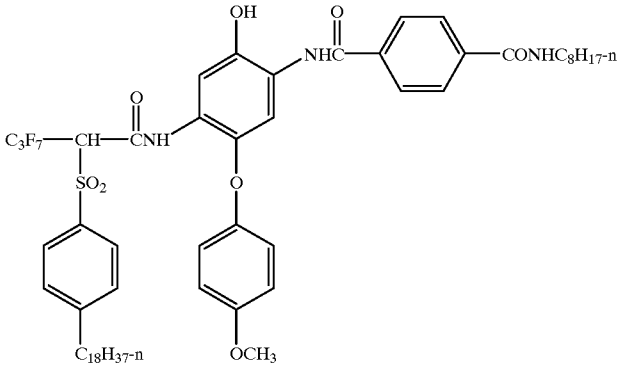
IC-20
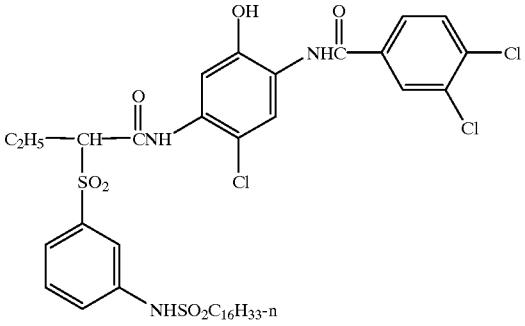
IC-21
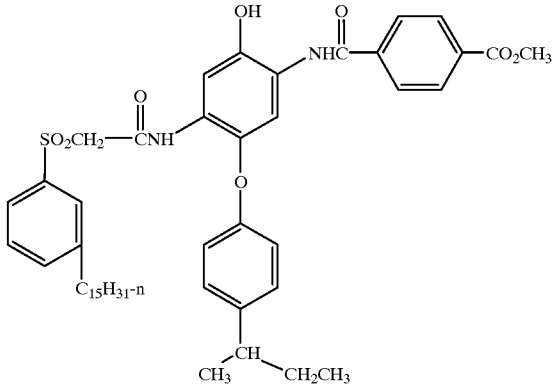
IC-22
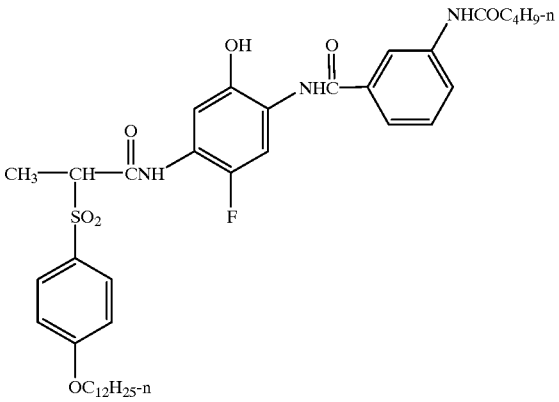
IC-23
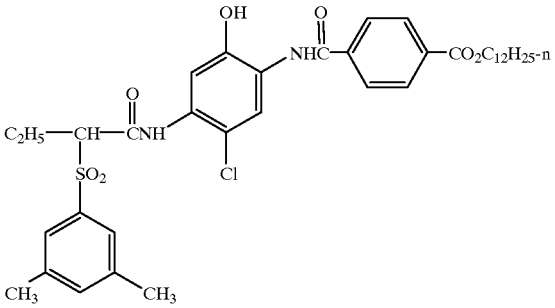

-continued
IC-24
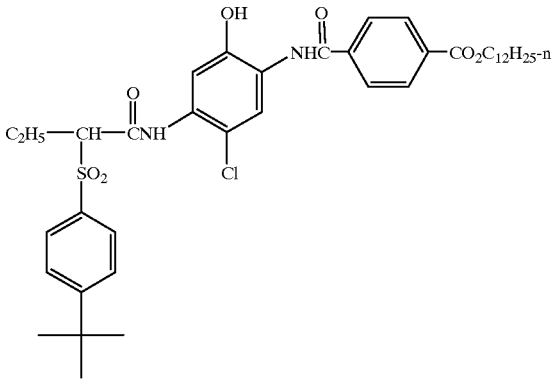
IC-25
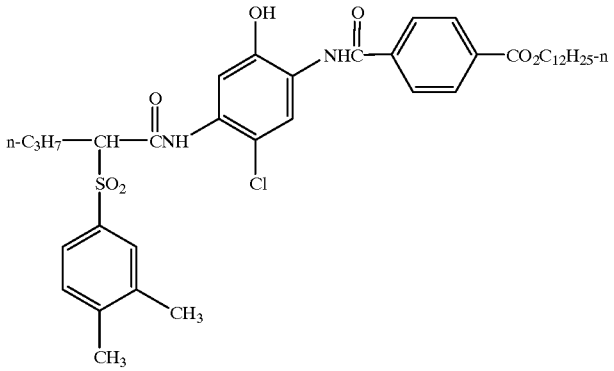
IC-26
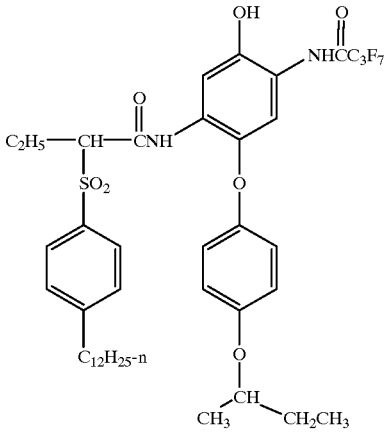
IC-27
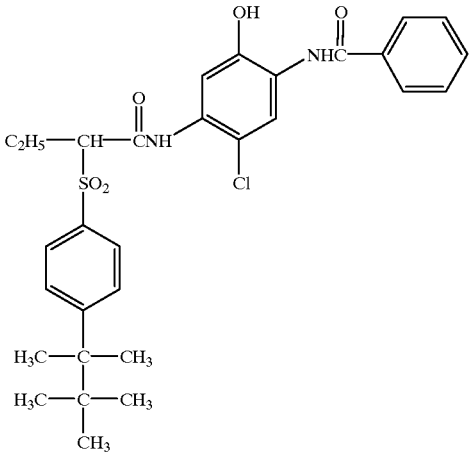
IC-28
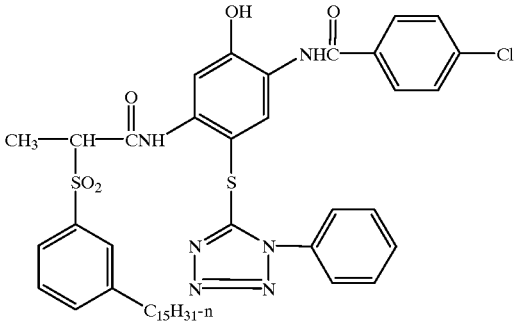
IC-29
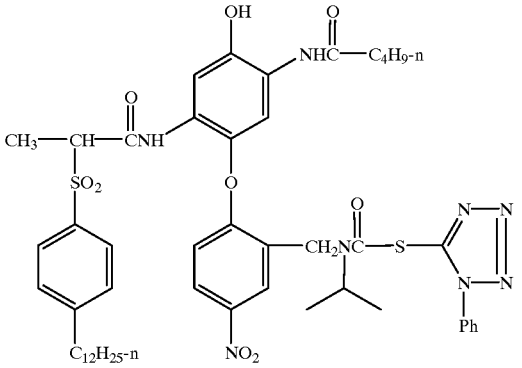

-continued

IC-30

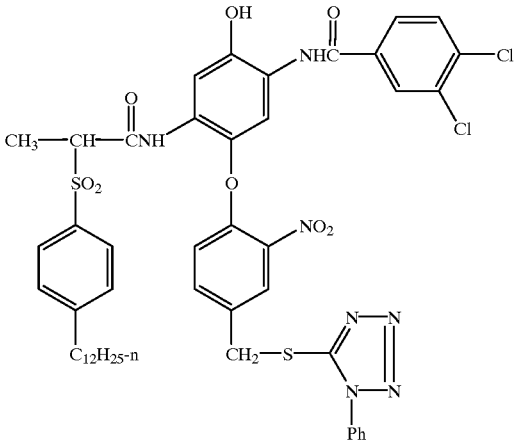

IC-31

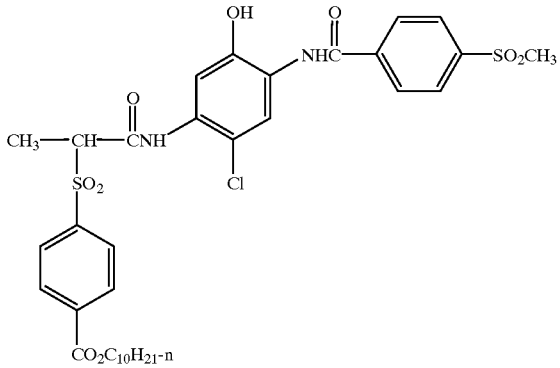

IC-32

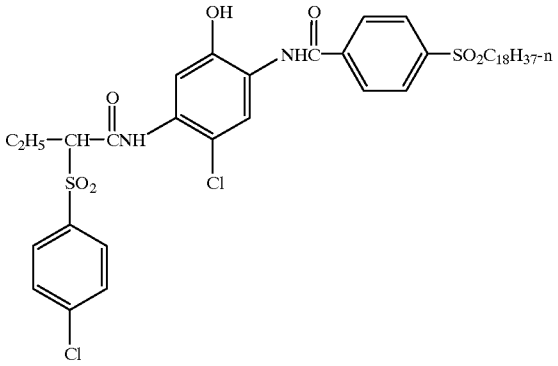

IC-33

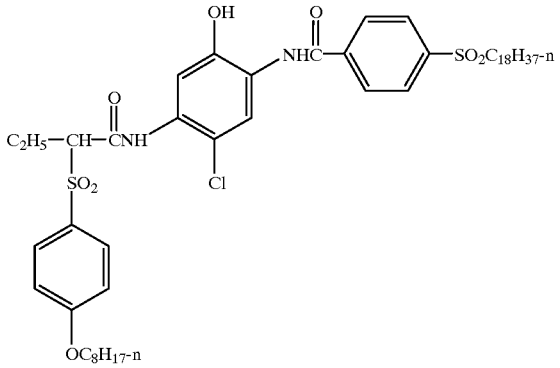

IC-34

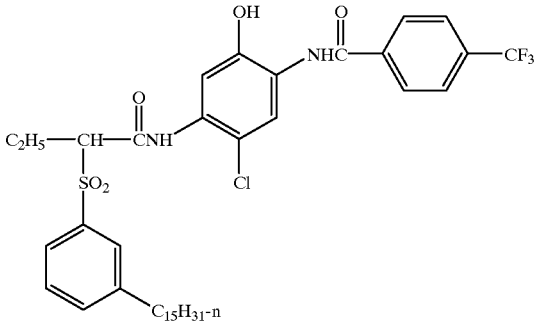

The magenta coupler utilized in the invention may be any magenta coupler of the following structure:

MAGENTA-1

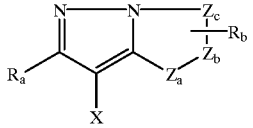

wherein $R_a$ and $R_b$ independently represent H or a substituent; X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one Of $Z_a$, $Z_b$, and $Z_c$ represents a methine group connected to the group $R_b$.

Preferred magenta couplers are 1H-pyrazolo [5,1-c]-1,2,4-triazole and 1H-pyrazolo [1,5-b]-1,2,4-triazole. Examples of 1H-pyrazolo [5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent applications 176,804; 177,765; U.S Pat. Nos. 4,659,652; 5,066,575; and 5,250,400.

In particular, pyrazoloazole magenta couplers of general structures PZ-1 and PZ-2 are especially preferred:

PZ-1

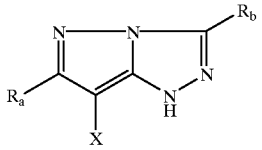

-continued

PZ-2

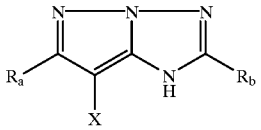

wherein $R_a$, $R_b$, and X are as defined for MAGENTA-1.

Particularly preferred are the two-equivalent versions of magenta couplers PZ-1 and PZ-2 wherein X is not equal to a hydrogen. This is the case because of the advantageous drop in silver required to reach the desired density in the print element.

Typical magenta couplers that may be used in the inventive photographic element are shown below.

M-1

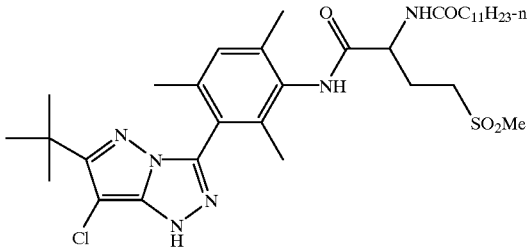

M-2

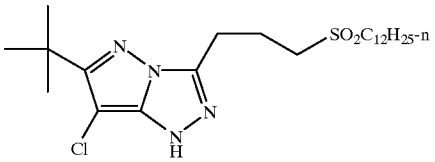

M-3

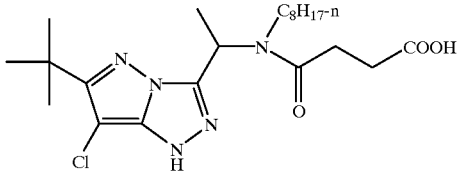

M-4

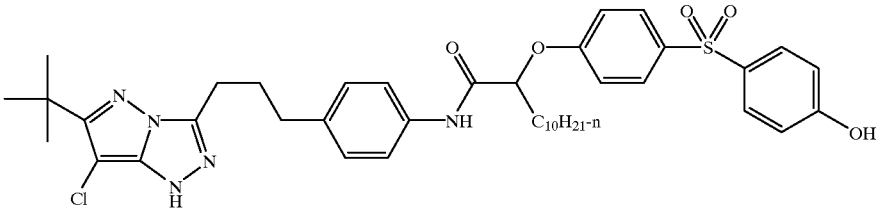

M-5

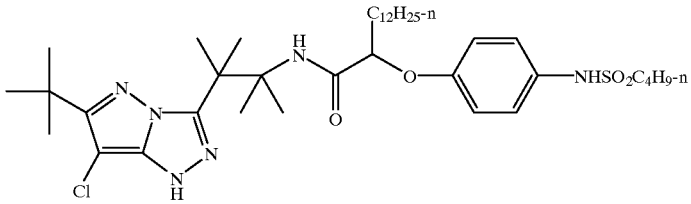

M-6

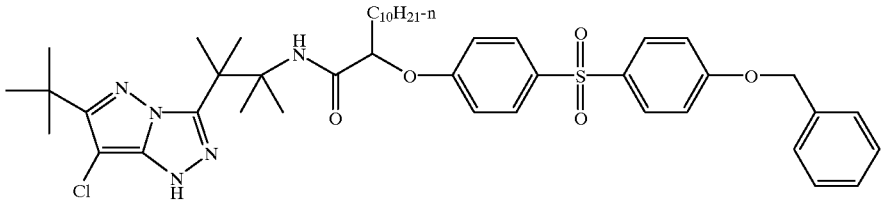

-continued

M-7

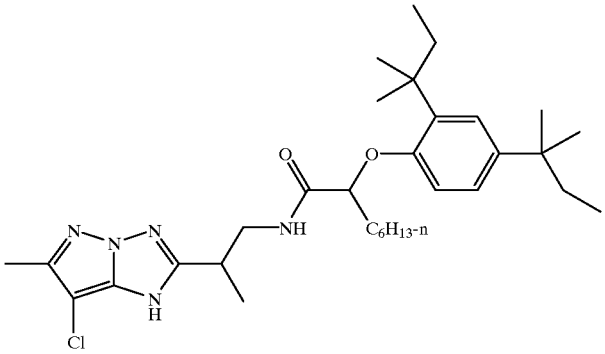

M-8

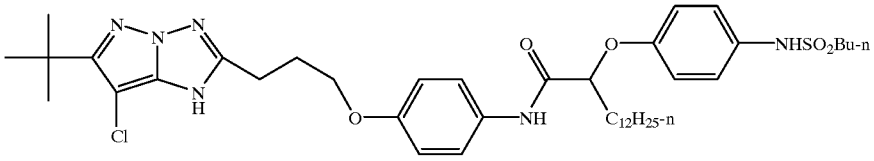

M-9

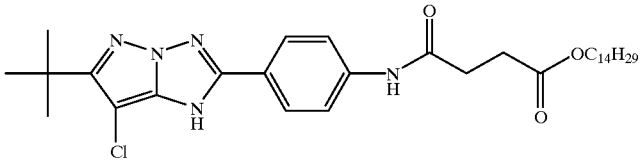

The most preferred magenta coupler is

M-2

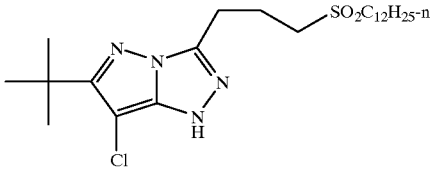

Couplers that form yellow dyes upon reaction with oxidized color developing agent and which are useful in elements of the invention are described in such representative patents and publications as: U.S. Pat. Nos. 2,875,057; 2,407,210; 3,265,506; 2,298,443; 3,048,194; 3,447,928 and "Farbkuppler—Eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803.

Typical preferred yellow couplers are represented by the following formulas:

YELLOW-1

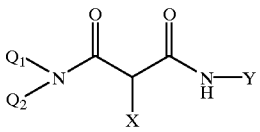

-continued

YELLOW-2

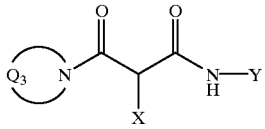

YELLOW-3

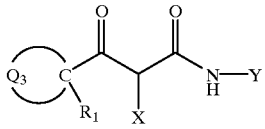

YELLOW-4

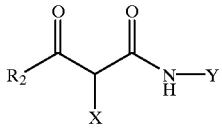

YELLOW-5

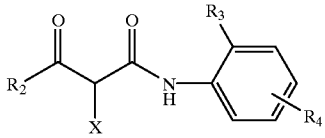

wherein $R_1$, $R_2$, $R_3$, $R_4$, $Q_1$ and $Q_2$ each represents a substituent; X is hydrogen or a coupling-off group; Y represents an aryl group or a heterocyclic group; $Q_3$ represents an organic residue required to form a nitrogen-containing heterocyclic group together with the >N—, and $Q_4$ represents nonmetallic atoms necessary to from a 3- to 5-membered hydrocarbon ring or a 3- to 5-membered heterocyclic ring which contains at least one hetero atom selected from N, O, S, and P in the ring. Particularly preferred is when $Q_1$ and $Q_2$ each represents an alkyl group, an aryl group, or a heterocyclic group, and $R_2$ represents an aryl or tertiary alkyl group. Preferred yellow couplers for use in elements of the invention are represented by YELLOW-4, wherein $R_2$ represents a tertiary alkyl group, Y represents an aryl group, and X represents an aryloxy or N-heterocyclic coupling-off group.

The most preferred yellow couplers are represented by YELLOW-5, wherein $R_2$ represents a tertiary alkyl group, $R_3$ represents a halogen or an alkoxy substituent, $R_4$ represents a substituent and X represents a N-heterocyclic coupling-off group because of their good development and desirable color.

Even more preferred are yellow couplers are represented by YELLOW-5, wherein $R_2$, $R_3$ and $R_4$ are as defined above, and X is represented by the following formula:

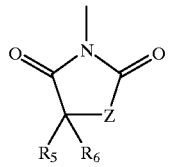

wherein Z is oxygen of nitrogen and $R_5$ and $R_6$ are substituents. Most preferred are yellow couplers wherein Z is oxygen and $R_5$ and $R_6$ are alkyl groups.

Typical yellow couplers that may be used in the inventive photographic element are shown below.

Y-1

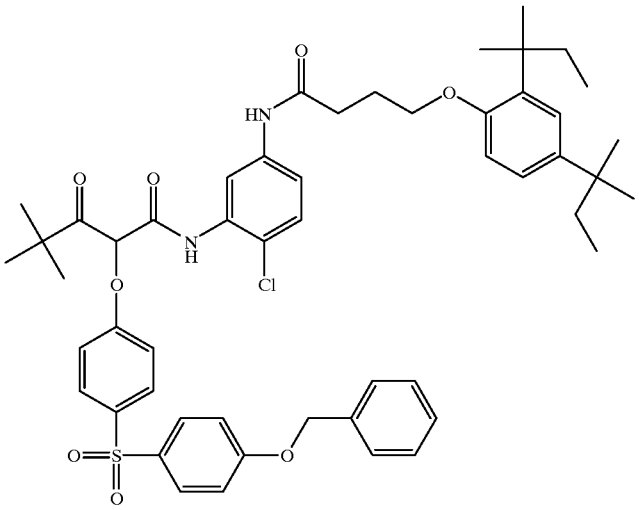

Y-2

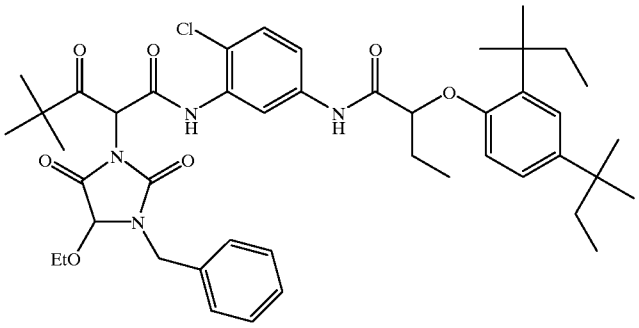

Y-3

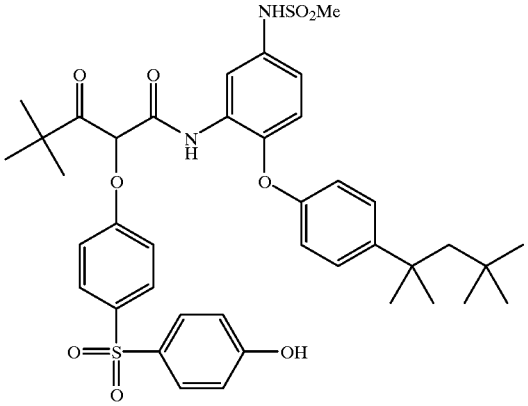

-continued
Y-4
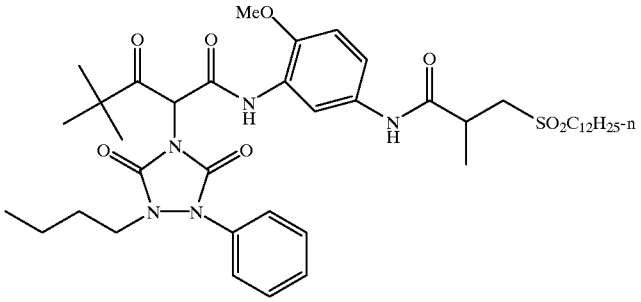
Y-5
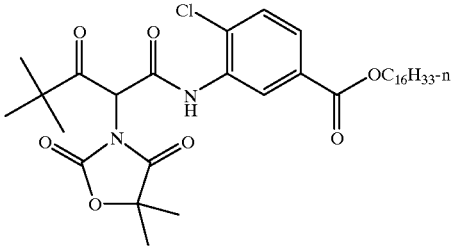
Y-6
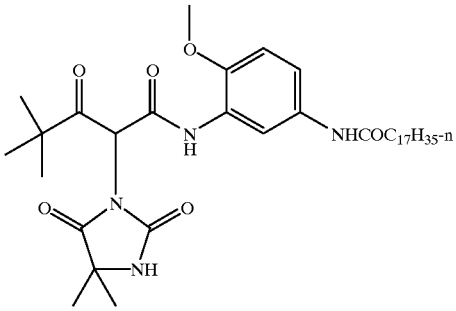
Y-7
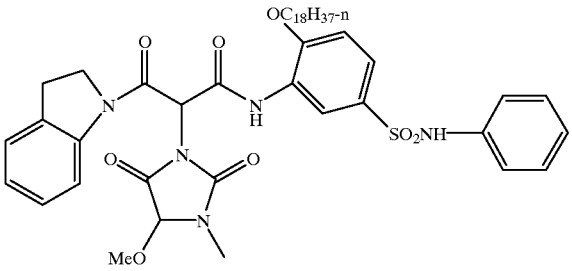
Y-8
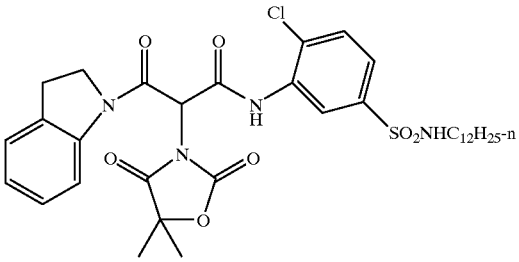

-continued

Y-9

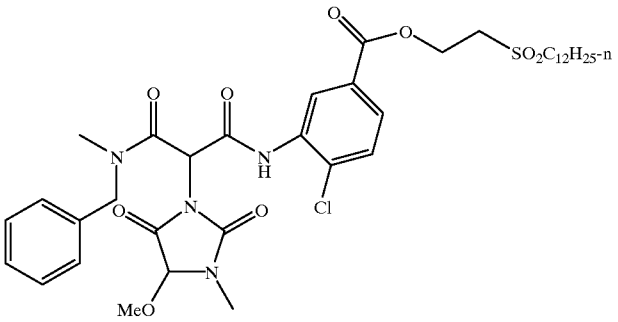

Y-10

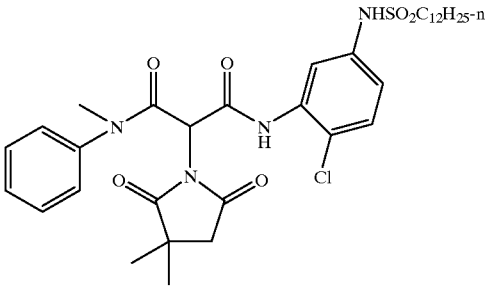

Y-11

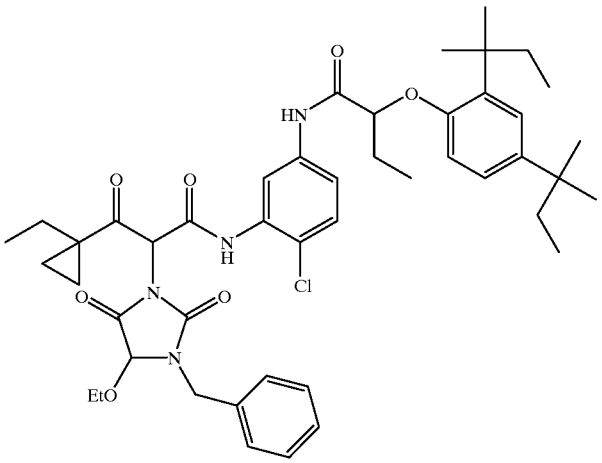

To control the migration of various components, it may be desirable to include a high molecular weight hydrophobe or "ballast" group in the component molecule. Representative ballast groups include substituted or unsubstituted alkyl or aryl groups containing 8 to 40 carbon atoms.

Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido (also known as acylamino), carbamoyl, alkylsulfonyl, arylsulfonyl, sulfonamido, and sulfamoyl groups wherein the substituents typically contain 1 to 40 carbon atoms. Such substituents can also be flirther substituted. Alternatively, the molecule can be made immobile by attachment to polymeric backbone.

Polymer containing dispersions of yellow photographic couplers have been employed in color print materials, as described in U.S. Pat. No. 15 4,857,449. Other methods for preparing polymer-containing dispersions of dye-forming couplers are described in U.S. Pat. Nos. 4,939,077; 4,203,716; and 4,840,885. Commonly, these dispersions are prepared from a solution of a coupler, an optional high-boiling solvent, an oil-soluble but water-insoluble polymer, and a volatile organic solvent, which solution is then emulsified and dispersed in an aqueous solution, often comprising water, a hydrophilic colloid such as gelatin, and a surfactant. Other methods describe the formation of loaded latex polymer dispersions using water-miscible or volatile organic solvent. We have also recently discovered that useful photographic coupler dispersions can be prepared by forming an loaded polymer latex dispersion, prepared either by high-shear mixing of a liquid oil phase with a latex-containing aqueous solution, or in some cases by combining a dispersion of a photographic coupler that is free of volatile organic solvent with a latex polymer, with sufficient surfactant and sufficient time to cause formation of a loaded latex dispersion. One of the main advantages of polymer-containing dispersions described in the prior art have included image preservability to heat and light, although other advantages in manufacturing processes, physical performance of the photographic element, and sensitometric performance have been reported.

Polymer containing dispersions used in the elements of the invention may be prepared by emulsifing a mixed oil solution comprising polymer and the photographically useful compounds desired in the dispersion, as described in U.S. Pat. Nos. 3,619,195 and 4,857,449.

Polymer-containing dispersions used in the elements of the invention may also be prepared as loaded latex dispersions. These may be prepared according to at least three types of process. The first process, described in, for example, U.S. Pat. No. 4,203,716, involves dissolving the hydrophobic photographically useful compounds to be loaded in a volatile or water miscible auxiliary solvent, combining this solution with an aqueous solution containing a polymer latex, and diluting the dispersion with additional aqueous solution or evaporating the auxiliary solvent to cause loading to occur. A second, more preferred method for preparing loaded latex formulations is to subject an oil solution or an aqueous dispersion of an oil solution comprising photographically useful compounds, to conditions of high shear or turbulence, in the presence of a polymer latex, with sufficient shear to cause loading as described in U.S. Pat. No. 5,594,047. A third possible way to prepare some loaded latex formulations is to simply combine a polymer latex with a dispersed oil solution, such that the oil solution and latex are miscible, in the presence of surfactant, for a sufficient time before the dispersion is coated for loading to occur as described in U.S. Pat. No. 5,558,980.

Polymers used in the invention are preferably water-insoluble, and sufficiently hydrophobic to be incorporated as components of the hydrophobic dispersed phase of the dispersions used in the elements of the invention. The polymers may be prepared by bulk polymerization or solution polymerization processes. Especially preferred among possible polymerization processes is the free-radical polymerization of vinyl monomers in solution.

Preferred latex polymers of the invention include addition polymers prepared by emulsion polymerization. Especially preferred are polymers prepared as latex with essentially no water-miscible or volatile solvent added to the monomer. Also suitable are dispersed addition or condensation polymers, prepared by emulsification of a polymer solution, or self-dispersing polymers.

Especially preferred latex polymers include those prepared by free-radical polymerization of vinyl monomers in aqueous emulsion. Polymers comprising monomers which form water-insoluble homopolymers are preferred, as are copolymers of such monomers, which may also comprise monomers which give water-soluble homopolymers, if the overall polymer composition is sufficiently water-insoluble to form a latex.

Examples of suitable monomers include allyl compounds such as allyl esters (e.g., allyl acetate, allyl caproate, etc.); vinyl ethers (e.g., methyl vinyl ether, butyl vinyl ether, methoxyethyl vinyl ether, ethoxyethyl vinyl ether, chloroethyl vinyl ether, l-methyl-2,2-dimethylpropyl vinyl ether, hydroxyethyl vinyl ether, diethylene glycol vinyl ether, dimethylaminoethyl vinyl ether, butylaminoethyl vinyl ether, benzyl vinyl ether, tetrahydrofurfuryl vinyl ether, etc.); vinyl esters (such as vinyl acetate, vinyl propionate, vinyl butyrate, vinyl isobutyrate, vinyl dimethyl propionate, vinyl ethyl butyrate, vinyl chloroacetate, vinyl dichloroacetate, vinyl methoxyacetate, vinyl phenyl acetate, vinyl acetoacetate, etc.); vinyl heterocyclic compounds (such as N-vinyl oxazolidone, N-vinylimidazole, N-vinylpyrrolidone, N-vinylcarbazole, vinyl thiophene, N-vinylethyl acetamide, etc.); styrenes (e.g., styrene, divinylbenzene, methylstyrene, dimethylstyrene, ethylstyrene, isopropylstyrene, sodium styrenesulfonate, potassium styrenesulfmate, butylstyrene, hexylstyrene, cyclohexylstyrene, benzylstyrene, chloromethylstyrene, trifluoromethylstyrene, acetoxymethylstyrene, acetoxystyrene, vinylphenol, (t-butoxycarbonyloxy)styrene, methoxystyrene, 4-methoxy-3-methylstyrene, dimethoxystyrene, chlorostyrene, dichlorostyrene, trichlorostyrene, bromostyrene, iodostyrene, fluorostyrene, methyl vinylbenzoate ester, vinylbenzoic acid, etc.); crotonic acids (such as crotonic acid, crotonic acid amide, crotonate esters (e.g., butyl crotonate, etc.)); vinyl ketones (e.g., methyl vinyl ketone, etc ); olefins (e.g., dicyclopentadiene, ethylene, propylene, 1-butene, 5,5-dimethyl-1-octene, etc.); itaconic acids and esters (e.g., itaconic acid, methyl itaconate, etc.), other acids such as sorbic acid, cinnamic acid, methyl sorbate, citraconic acid, chloroacrylic acid mesaconic acid, maleic acid, fumaric acid, and ethacrylic acid; halogenated olefins (e.g., vinyl chloride, vinylidene chloride, etc.); unsaturated nitriles (e.g., acrylonitrile, etc.); acrylic or methacrylic acids and esters (such as acrylic acid, methyl acrylate, methacrylic acid, methyl methacrylate, ethyl acrylate, butyl acrylate, butyl methacrylate, 2-hydroxyethyl methacrylate, 2-acetoacetoxyethyl methacrylate, sodium-2-sulfoethyl acrylate, 2-aminoethylmethacrylate hydrochloride, glycidyl methacrylate, ethylene glycol dimethacrylate, etc.); and acrylamides and methacrylamides (such as acrylamide, methacrylamide, N-methylacrylamide, N,N-dimethylacrylamide, N-isopropylacrylamide, N-s-butylacrylamide, N-t-butylacrylamide, N-cyclohexylacrylamide, N-(3-aminopropyl) methacrylamide hydrochloride, N-(3-dimethylaminopropyl) methacrylamide hydrochloride, N,N-dipropylacrylamide, N-(1,1-dimethyl-3-oxobutyl)acrylamide, N-(1,1,2-trimethylpropyl)acrylamide, N-(1,1,3,3-tetramethylbutyl) acrylamide, N-(1-phthalamidomethyl)acrylamide, sodium N-(1,1-dimethyl-2-sulfoethyl)acrylamide, N-butylacrylamide, N-(1,1-dimethyl-3-oxobutyl) acrylamide, N-(2-carboxyethyl)acrylamide, 3-acrylamido-3-methylbutanoic acid, methylene bisacrylamide, etc.).

Specific examples of useful polymers and polymer latex materials are given below:

P-1 Poly(N-tert-butylacrylamide)

P-2 Poly(N-cyclohexylamide)

P-3 Poly(N-sec-butylacrylamide)

P-4 Poly(N-(1,1,3,3-tetramethylbutyl)acrylamide)

P-5 Poly(N-(1,1,2-trimethylpropyl)acrylamide)

P-6 Poly(N-(1,1-dimethyl-3-oxobutyl)acrylamide)

P-7 Poly(N-(1-phthalimidomethyl)acrylamide)

P-8 Poly(N,N-di-n-propylacrylamide)

P-9 N-tert-butylacrylamide/2-hydroxyethylmethacrylate copolymer (80/20) (by weight, hereinafter the same)

P-10 N-tert-butylacrylamide/methylene bisacrylamide copolymer (98/2)

P-11 N-cyclohexylacrylamide/methylene bisacrylamide copolymer (98/2)

P-12 1,1-dimethyl-3-oxobutyl)acrylamide/methylene bisacrylamide copolymer (98/2)

P-13 Methyl acrylate/2-acr ylamido-2-methylpropane sulfonic acid copolymer (96/4)

P-14 Methyl acrylate/2-acrylamido-2-methylpropane sulfonic acid copolymer (98/2)

P-15 Methyl acrylate/2-acrylamido-2-methylpropane sulfonic acid/2-acetoacetoxyethyl methacrylate copolymer (91/5/4)

P-16 Methyl acrylate/2-acrylamido-2-methylpropane sulfonic acid/ethylene glycol dimethacrylate copolymer (96/2/2)

P-17 Butyl acrylate/2-acrylamido-2-methylpropane sulfonic acid sodium salt/2-acetoacetoxyethyl methacrylate copolymer (90/6/4)

P-1 8 Butyl acrylate/2-acrylamido-2-methylpropane sulfonic acid/ethylene glycol dimethacrylate copolymer (90/6/4)

P-19 Butyl acrylate/styrene/methacrylamide/2-acrylamido-2-methylpropane sulfonic acid sodium salt copolym er (55/29/11/5)

P-20 Butyl acrylate/styrene/2-acrylamido-2-methylpropane sulfonic acid sodium salt copolymer (85/10/5

P-31 Poly(methylmethacrylate)

P-32 Glycidyl methacrylate/ethylene glycol dimethacrylate copolymer (95/5)

P-33 Poly(acrylonitrile)

P-34 Acrylonitrile/vinylidene chloride/acrylic acid copolymer (15/79/6)

P-35 Styrenelbutyl methacrylate/2-sulfoethyl methacrylate sodium salt copolymer (30/60/10)

P-36 Polystyrene

P-37 Poly(4-acetoxystyrene)

P-38 Poly(4-vinylphenol)

P-39 Poly(4-t-butoxycarbonyloxystyrene)

P-40 2-(2'-Hydroxy-5'-methacrylyloxyethylphenyl)-2H-benzotriazole/ethyl acrylate/2-acrylamido-2-methylpropane sulfonic acid sodium salt copolymer (74/23/3)

P-41 N-tert-butylacrylamide/3-acrylamido-3-methylbutanoic acid copolymer (99.5/0.5)

P-42 N-tert-butylacrylamide/3-acrylamido-3-methylbutanoic acid copolymer (99.0/1.0)

P-43 N-tert-butylacrylamide/3-acrylarnido-3-methylbutanoic acid copolymer (98/2)

P-44 N-tert-butylacrylamnide/3-acrylamido-3-methylbutanoic acid copolymer (96/4)

P-45 N-tert-butylacrylamide/3-acrylamido-3-methylbutanoic acid copolymer (92/8)

P46 N-tert-butylacrylaniide/methyl acrylate copolymer (25/75)

P-47 N-tert-butylacrylamide/methyl acrylate copolymer (50/50)

P-48 N-tert-butylacrylamide/methyl acrylate copolymer (75/25)

P-49 Poly(methyl acrylate)

P-50 Methyl metliacrylate/methyl acrylate copolymer (75/25)

P-51 Methyl metbacrylate/methyl acrylate copolymer (50/50)

P-52 Methyl methacrylate/methyl acrylate copolymer (25/75)

P-53 N-tert-butylacrylamide/2-acrylamido-2-methylpropane sulfonic acid sodium salt copolymer (98/2)

P-54 N-tert-butylacrylamide/2-acrylamido-2-methylpropane sulfonic acid sodium salt copolymer (99/1)

P-55 Methyl methacrylate/2-acrylamido-2-methylpropane sulfonic acid sodium salt copolymer (98/2)

P-56 N-tert-butylacrylamide/n-butyl acrylate copolymer (50/50)

Suitable free-radical initiators for the polymerization include, but are not limited to, the following compounds and classes. Inorganic salts suitable as initiators include potassium persulfate, sodium persulfate, potassium persulfate with sodium sulfite, etc. Peroxy compounds which may be used include benzoyl peroxide, t-butyl hydroperoxide, cumyl hydroperoxide, etc. Azo compounds which may be used include azobis(cyanovaleric acid), azobis-(isobutyronitrile), 2,2'-azobis(2-amidinopropane) dihydrochloride, etc.

The support utilized in the photographic elements of the invention may be any suitable material- Suitable materials include paper, resin coated paper, transparent and opaque plastic sheets. The preferred sheets are about 7 mils thickness.

It has been found that the ultraviolet material is more effective if placed more toward the surface of the photographic element. It is preferred that it be placed above the blue light sensitive layer rather than in lower interlayers.

It is understood throughout this disclosure that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form, but also its form substituted with any photographically usefial substituents. Usually the substituent will have less than 30 carbon atoms and typically less than 20 carbon atoms. Typical examples of substituents include alkyl, aryl, anilino, carbonamido, sulfonamido, alkylthio, arylthio, alkenyl, cycloalkyl, and further to these exemplified are halogen, cycloalkenyl, alkinyl, heterocyclyl, sulfonyl, sulfinyl, phosphonyl, acyl, carbamoyl, sulfamoyl, cyano, alkoxy, aryloxy, heterocyclyloxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclylthio, spiro compound residues, and bridged hydrocarbon compound residues.

In this invention, the presence of an interlayer containing an anticolor-mixing agent (antistain or oxidized developer scavenger) is preferred. Typically, these scavengers are ballasted to keep them in the layer in which they were coated. The scavengers work by reducing any excess oxidized developer back to the developer form. Anticolor-mixing agents include compounds such as derivatives of hydroquinones (e.g. see U.S. Pat. Nos. 2,336,327; 2,360,290; 2,403,721; 2,701,197; 2,728,659; and 3,700,453) aminophenols, amines, gallic acid, catechol, ascorbic acid, hydrazides (e.g. U.S. Pat. No. 4,923,787), sulfonamidophenols (e.g. U.S. Pat. No. 4,447,523), and non color-forming couplers.

It is also contemplated that the concepts of the discussion may be employed to obtain reflection color prints as described in *Research Disclosure*, November 1979, Item 18716. The photographic element may contain epoxy 15 solvents (EP 164,961); ballasted chelating agents such as those in U.S. Pat. No. 4,994,359 to reduce sensitivity to polyvalent cations such as calcium; and stain reducing compounds such as described in U.S. Pat. Nos. 5,068,171; 5,096,805; and 5,126,234. The particular base material utilized may be any material conventionally used in silver halide color papers. Such materials are disclosed in *Research Disclosure*, September 1994, Item 36544, Section XV. It may be desired to coat the photographic element on pH adjusted support as described in U.S. Pat. No. 4,917,994. If desired, false sensitization, as described in Hahm in U.S. Pat. No. 4,902,609, can be used to provide added detail in color paper embodiments.

In addition, emulsions can be sensitized with mixtures of two or more sensitizing dyes which form mixed dye aggregates on the surface of the emulsion grain. The use of mixed dye aggregates enables adjustment of the spectral sensitivity of the emulsion to any wavelength between the extremes of the wavelengths of peak sensitivities ($\lambda$-max) of the two or more dyes. This practice is especially valuable if the two or more sensitizing dyes absorb in similar portions of the spectrum (i.e., blue, or green or red and not green plus red or blue plus red or green plus blue). Since the function of the spectral sensitizing dye is to modulate the information recorded in the negative which is recorded as an image dye, positioning the peak spectral sensitivity at or near the λ-max of the image dye in the color negative produces the optimum preferred response.

In addition, emulsions of this invention may contain a mixture of spectral sensitizing dyes which are substantially different in their light absorptive properties. For example, Hahm in U.S. Pat. No. 4,902,609 describes a method for broadening the effective exposure latitude of a color negative paper by adding a smaller amount of green spectral sensitizing dye to a silver halide emulsion having predominately a red spectral sensitivity. Thus when the red sensitized emulsion is exposed to green light, it has little, if any, response. However, when it is exposed to larger amounts of green light, a proportionate amount of cyan image dye will be formed in addition to the magenta image dye, causing it to appear to have additional contrast and, hence, a broader exposure latitude.

Waki et al in U.S. Pat. No. 5,084,374 describes a silver halide color photographic material in which the red spectrally sensitized layer and the green spectrally sensitized layers are both sensitized to blue light. Like Hahm, the second sensitizer is added in a smaller amount to the primary sensitizer. When these imaging layers are given a large enough exposure of the blue light exposure, they produce yellow image dye to complement the primary exposure. This process of adding a second spectral sensitizing dye of different primary absorption is called false-sensitization.

Any silver halide combination can be used, such as silver chloride, silver chlorobromide, silver chlorobromoiodide, silver bromide, silver bromoiodide, or silver chloroiodide. Due to the need for rapid processing of the color paper, silver chloride emulsions are preferred. In some instances, silver chloride emulsions containing small amounts of bromide, or iodide, or bromide and iodide are preferred, generally less than 2.0 mole percent of bromide less than 1.0 mole percent of iodide. Bromide or iodide addition when forming the emulsion may come from a soluble halide source such as potassium iodide or sodium bromide or an organic bromide or iodide or an inorganic insoluble halide such as silver bromide or silver iodide.

The shape of the silver halide emulsion grain can be cubic, pseudo-cubic, octahedral, tetradecahedral or tabular. It is preferred that the 3-dimensional grains be monodisperse and that the grain size coefficient of variation of the 3-dimensional grains is less than 35% or, most preferably less than 25%. The emulsions may be precipitated in any suitable environment such as a ripening environment, or a reducing environment. Specific references relating to the preparation of emulsions of differing halide ratios and morphologies are Evans U.S. Pat. No. 3,618,622; Atwell U.S. Pat. No. 4,269,927; Wey U.S. Pat. No. 4,414,306; Maskasky U.S. Pat. No. 4,400,463; Maskasky U.S. Pat. No. 4,713,323; Tufano et al U.S. Pat. No. 4,804,621; Takada et al U.S. Pat. No. 4,738,398; Nishikawa et al U.S. Pat. No. 4,952,491; Ishiguro et al U.S. Pat. No. 4,493,508; Hasebe et al U.S. Pat. No. 4,820,624; Maskasky U.S. Pat. No. 5,264,337; and Brust et al EP 534,395.

The combination of similarly spectrally sensitized emulsions can be in one or more layers, but the combination of emulsions having the same spectral sensitivity should be such that the resultant D vs. log-E curve and its corresponding instantaneous contrast curve should be such that the instantaneous contrast of the combination of similarly spectrally sensitized emulsions generally increases as a function of exposure.

Emulsion precipitation is conducted in the presence of silver ions, halide ions and in an aqueous dispersing medium including, at least during grain growth, a peptizer. Grain structure and properties can be selected by control of precipitation temperatures, pH and the relative proportions of silver and halide ions in the dispersing medium. To avoid fog, precipitation is customarily conducted on the halide side of the equivalence point (the point at which silver and halide ion activities are equal). Manipulations of these basic parameters are illustrated by the citations including emulsion precipitation descriptions and are further illustrated by Matsuzaka et al U.S. Pat. No. 4,497,895; Yagi et al U.S. Pat. No. 4,728,603; Sugimoto U.S. Pat. No. 4,755,456; Kishita et al U.S. Pat. No. 4,847,190; Joly et al U.S. Pat. No. 5,017,468; Wu U.S. Pat. No. 5,166,045; Shibayama et al EPO 0 328 042; and Kawai EPO 0 531 799.

Reducing agents present in the dispersing medium during precipitation can be employed to increase the sensitivity of the grains, as illustrated by Takada et al U.S. Pat. No. 5,061,614; Takada U.S. Pat. No. 5,079,138; and EPO 0 434 012, Inoue U.S. Pat. No. 5,185,241; Yamashita et al EPO 0 369 491; Ohashi et al EPO 0 371 338; Katsumi EPO 435 270 and 0 435 355; and Shibayama EPO 0 438 791. Chemically sensitized core grains can serve as hosts for the precipitation of shells, as illustrated by Porter et al U.S. Pat. Nos. 3,206,313 and 3,327,322; Evans U.S. Pat. No. 3,761,276; Atwell et al U.S. Pat. No. 4,035,185; and Evans et al U.S. Pat. No. 4,504,570.

Dopants (any grain occlusions other than silver and halide ions) can be employed to modify grain structure and properties. Periods 3–7 ions, including Group VIII metal ions (Fe, Co, Ni and platinum metals (pm) Ru, Rh, Pd, Re, Os, Ir and Pt), Mg, Al, Ca, Sc, Ti, V, Cr, Mn, Cu Zn, Ga, As, Se, Sr, Y, Mo, Zr, Nb, Cd, In, Sn, Sb, Ba, La, W, Au, Hg, Tl, Pb, Bi, Ce and U can be introduced during precipitation. The dopants can be employed (a) to increase the sensitivity of either (a1) direct positive or (a2) negative working emulsions, (b) to reduce (b1) high or (b2) low intensity reciprocity failure, (c) to (c1) increase, (c2) decrease or (c3) reduce the variation of contrast, (d) to reduce pressure sensitivity, (e) to decrease dye desensitization, (f) to increase stability, (g) to reduce minimum density, (h) to increase maximum density, (i) to improve room light handling and (j) to enhance latent image formation in response to shorter wavelength (e.g. X-ray or gamma radiation) exposures. For some uses any polyvalent metal ion (pvmi) is effective. The selection of the host grain and the dopant, including its concentration and, for some uses, its location within the host grain and/or its valence, can be varied to achieve aim photographic properties, as illustrated by B. H. Carroll, "Iridium Sensitization: A Literature Review", *Photographic Science and Engineering*, Vol. 24, No. 6 November/December 1980, pp. 265–267 (pm, Ir, a, b and d); Hochstetter U.S. Pat. No. 1,951,933 (Cu); De Witt U.S. Pat. No. 2,628,167 (Tl, a, c); Mueller et al U.S. Pat. No. 2,950,972 (Cd, j); Spence et al U.S. Pat. No. 3,687,676 and Gilman et al U.S. Pat. No. 3,761,267 (Pb, Sb, Bi, As, Au, Os, Ir, a); Ohkubu et al U.S. Pat. No. 3,890,154 (VIII, a); Iwaosa et al U.S. Pat. No. 3,901,711 (Cd, Zn, Co, Ni, Tl, U, Th, Ir, Sr, Pb, b1); Habu et al U.S. Pat. No. 4,173,483 (VIII, b1); Atwell U.S. Pat. No. 4,269,927 (Cd, Pb, Cu, Zn, a2); Weyde U.S. Pat. No. 4,413,055 (Cu, Co, Ce, a2); Akimura et al U.S. Pat. No. 4,452,882 (Rh, i); Menjo et al U.S. Pat. No. 4,477,561 (pm, f); Habu et al U.S. Pat. No. 4,581,327 (Rh, c1, f); Kobuta et al U.S. Pat. No. 4,643,965 (VIII, Cd, Pb, f, c2); Yamashita et al U.S. Pat. No. 4,806,462 (pvmi, a2, g); Grzeskowiak et al U.S. Pat. No. 4,4,828,962 (Ru+Ir, b1);

Janusonis U.S. Pat. No. 4,835,093 (Re, a1); Leubner et al U.S. Pat. No. 4,902,611 (Ir+4); Inoue et al U.S. Pat. No. 4,981,780 (Mn, Cu, Zn, Cd, Pb, Bi, In, Tl, Zr, La, Cr, Re, VIII, c1, g, h); Kim U.S. Pat. No. 4,997,751 (Ir, b2); Kuno U.S. Pat. No. 5,057,402 (Fe, b, f); Maekawa et al U.S. Pat. No. 5,134,060 (Ir, b, c3); Kawai et al U.S. Pat. No. 5,164,292 (Ir+Se, b); Asami U.S. Pat. No. 5,166,044 and 5,204,234 (Fe+Ir, a2 b, c1, c3); Wu U.S. Pat. No. 5,166,045 (Se, a2); Yoshida et al U.S. Pat. No. 5,229,263 (Ir+Fe/Re/Ru/Os, a2, bl); Marchetti et al U.S. Pat. Nos. 5,264,336 and 5,268,264 (Fe, g); Komarita et al EPO 0 244 184 (Ir, Cd, Pb, Cu, Zn, Rh, Pd, Pt, TI, Fe, d); Miyoshi et al EPO 0 488 737 and 0 488 601 (Ir+VIIl/Sc/Ti/V/Cr/Mn/Y/Zr/Nb/Mo/La/Ta/W/Re, a2, b, g); Ihama et al EPO 0 368 304 (Pd, a2, g); Tashiro EPO 0 405 938 (Ir, a2, b); Murakami et al EPO 0 509 674 (VIII, Cr, Zn, Mo, Cd, W, Re, Au, a2, b, g) and Budz WO 93/02390 (Au, g); Ohkubo et al U.S. Pat. No. 3,672,901 (Fe, a2, ol); Yamasue et al U.S. Pat. No. 3,901,713 (Ir+Rh, f); and Miyoshi et al EPO 0 488 737.

When dopant metals are present during precipitation in the form of coordination complexes, particularly tetra- and hexa-coordination complexes, both the metal ion and the coordination ligands can be occluded within the grains. Coordination ligands, such as halo, aquo, cyano, cyanate, fulminate, thiocyanate, selenocyanate, nitrosyl, thionitrosyl, oxo, carbonyl and ethylenediamine tetraacetic acid (EDTA) ligands have been disclosed and, in some instances, observed to modify emulsion properties, as illustrated by Grzeskowiak U.S. Pat. No. 4,847,191; McDugle et al U.S. Pat. Nos. 4,933,272; 4,981,781; and 5,037,732; Marchetti et al U.S. Pat. No. 4,937,180; Keevert et al U.S. Pat. No. 4,945,035; Hayashi U.S. Pat. No. 5,112,732; Murakami et al EPO 0 509 674; Ohya et al EPO 0 513 738; Janusonis WO 91/10166; Beavers WO 92/16876; Pietsch et al German DD 298,320; and Olm et al U.S. Pat. No. 5,360,712.

Oligomeric coordination complexes can also be employed to modify grain properties, as illustrated by Evans et al U.S. Pat. No. 5,024,931.

Dopants can be added in conjunction with addenda, antifoggants, dye, and stabilizers either during precipitation of the grains or post precipitation, possibly with halide ion addition. These methods may result in dopant deposits near or in a slightly subsurface fashion, possibly with modified emulsion effects, as illustrated by Ihama et al U.S. Pat. No. 4,693,965 (Ir, a2); Shiba et al U.S. Patent 3,790,390 (Group VIII, a2, bl); Habu et al U.S. Pat. No. 4,147,542 (Group VIII, a2, b1); Hasebe et al EPO 0 273 430 (Ir, Rh, Pt); Ohshima et al EPO 0 312 999 (Ir, f); and Ogawa U.S. Statutory Invention Registration H760 (Ir, Au, Hg, Ti, Cu, Pb, Pt, Pd, Rh, b, f).

Desensitizing or contrast increasing ions or complexes are typically dopants which function to trap photogenerated holes or electrons by introducing additional energy levels deep within the bandgap of the host material. Examples include, but are not limited to, simple salts and complexes of Groups 8–10 transition metals (e.g., rhodium, iridium, cobalt, ruthenium, and osmium), and transition metal complexes containing nitrosyl or thionitrosyl ligands as described by McDugle et al U.S. Pat. No. 4,933,272. Specific examples include $K_3RhCl_6$, $(NH_4)_2Rh(Cl_5)H_2O$, $K_2IrCl_6$, $K_3IrCl_6$, $K_2IrBr_6$, $K_2IrRuCl_6$, $K_2Ru(NO)Br_5$, $K_2Ru(NS)Br_5$, $K_2OsCl_6$, $Cs_2Os(NO)Cl_5$, and $K_2OsNS)Cl_5$. Amine, oxalate, and organic ligand complexes of these or other metals as disclosed in Olm et al U.S. Pat. No. 5,360,712 are also specifically contemplated.

Shallow electron trapping ions or complexes are dopants which introduce additional net positive charge on a lattice site of the host grain, and which also fail to introduce an additional empty or partially occupied energy level deep within the bandgap of the host grain. For the case of a six coordinate transition metal dopant complex, substitution into the host grain involves omission from the crystal structure of a silver ion and six adjacent halide ions (collectively referred to as the seven vacancy ions). The seven vacancy ions exhibit a net charge of −5. A six coordinate dopant complex with a net charge more positive than −5 will introduce a net positive charge onto the local lattice site and can function as a shallow electron trap. The presence of additional positive charge acts as a scattering center through the Coulomb force, thereby altering the kinetics of latent image formation.

Based on electronic structure, common shallow electron trapping ions or complexes can be classified as metal ions or complexes which have (i) a filled valence shell or (ii) a low spin, half-filled d shell with no low-lying empty or partially filled orbitals based on the ligand or the metal due to a large crystal field energy provided by the ligands. Classic examples of class (i) type dopants are divalent metal complex of Group II, e.g., Mg(2+), Pb(2+), Cd(2+), Zn(2+), Hg(2+), and Tl(3+). Some type (ii) dopants include Group VIII complex with strong crystal field ligands such as cyanide and thiocyanate. Examples include, but are not limited to, iron complexes illustrated by Olkubo U.S. Pat. No. 3,672,901; and rhenium, ruthenium, and osmium complexes disclosed by Keevert U.S. Pat. No. 4,945,035; and iridium and platinum complexes disclosed by Ohshima et al U.S. Pat. No. 5,252,456. Preferred complexes are ammonium and alkali metal salts of low valent cyanide complexes such as $K_4Fe(CN)_6$, $K_4Ru(CN)_6$, $K_4Os(CN)_6$, $K_2Pt(CN)_4$, and $K_3Ir(CN)_6$. Higher oxidation state complexes of this type, such as $K_3Fe(CN)_6$ and $K_3Ru(CN)_6$, can also possess shallow electron trapping characteristics, particularly when any partially filled electronic states which might reside within the bandgap of the host grain exhibit limited interaction with photocharge carriers.

Emulsion addenda that absorb to grain surfaces, such as antifoggants, stabilizers and dyes can also be added to the emulsions during precipitation. Precipitation in the presence of spectral sensitizing dyes is illustrated by Locker U.S. Pat. No. 4,183,756; Locker et al U.S. Pat. No. 4,225,666; Ihama et al U.S. Pat. Nos. 4,683,193 and 4,828,972; Takagi et al U.S. Pat. No. 4,912,017; Ishiguro et al U.S. Pat. No. 4,983,508; Nakayama et al U.S. Pat. No. 4,996,140; Steiger U.S. Pat. No. 5,077,190; Brugger et al U.S. Pat. No. 5,141,845; Metoki et al U.S. Pat. No. 5,153,116; Asami et al EPO 0 287 100 and Tadaaki et al EPO 0 301 508. Non-dye addenda are illustrated by Klotzer et al U.S. Pat. No. 4,705,747; Ogi et al U.S. Pat. No. 4,868,35 USC § 102; Ohya et al U.S. Pat. No. 5,015,563; Bahnmuller et al U.S. Pat. No. 5,045,444; Maeka et al U.S. Pat. No. 5,070,008; and Vandenabeele et al EPO 0 392 092.

Chemical sensitization of the materials in this invention is accomplished by any of a variety of known chemical sensitizers. The emulsions described herein may or may not have other addenda such as sensitizing dyes, supersensitizers, emulsion ripeners, gelatin, or halide conversion restrainers present before, during, or after the addition of chemical sensitization.

The use of sulfur, sulfur plus gold or gold only sensitizations are very effective sensitizers. Typical gold sensitizers are chloroaurates, aurous dithiosulfate, aqueous colloidal gold sulfide or gold [aurous bis(1,4,5-trimethyl-1,2,4-triazolium-3-thiolate)] tetrafluoroborate. Sulfur sensitizers may include thiosulfate, thiocyanate or N,N'-carbobothioyl-bis(N-methylglycine).

The addition of one or more antifoggants as stain reducing agents is also common in silver halide systems. Tetrazaindenes, such as 4-hydroxy-6-methyl-(1,3,3a,7)-tetrazaindene, are commonly used as stabilizers. Also useful are mercaptotetrazoles such as 1-phenyl-5-mercaptotetrazole or acetamido-1-phenyl-5-mercaptotetrazole. Arylthiosulfinates, such as tolylthiosulfonate or arylsufinates such as tolylthiosulfinate or esters thereof, are also useful.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 $\mu$m (0.5 $\mu$m for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.06 micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above, tabular grains of less than the specified thickness account for at least 50 percent of the total grain projected area of the emulsion. To maximize the advantages of high tabularity, it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire PO10 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069; and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

Processing a silver halide color photographic light-sensitive material is basically composed of two steps of 1) color development and 2) desilvering. The desilvering stage comprises a bleaching step to change the developed silver back to an ionic-silver state and a fixing step to remove the ionic silver from the light-sensitive material. The bleaching and fixing steps can be combined into a monobath bleach-fix step that can be used alone or in combination with the bleaching and the fixing step. If necessary, additional processing steps may be added, such as a washing step, a stopping step, a stabilizing step and a pretreatment step to accelerate development. The processing chemicals used may be liquids, pastes, or solids, such as powders, tablets, or granules.

In color development, silver halide that has been exposed to light is reduced to silver, and at the same time, the oxidized aromatic primary amine color developing agent is consumed by the above mentioned reaction to form image dyes. In this process halide ions from the silver halide grains are dissolved into the developer, where they will accumulate. In addition, the color developing agent is consumed by the aforementioned reaction of the oxidized color developing agent with the coupler. Furthermore, other components in the color developer will also be consumed and the concentration will gradually be lowered as additional development occurs. In a batch-processing method, the performance of the developer solution will eventually be degraded as a result of the halide ion build-up and the consumption of developer components. Therefore, in a development method that continuously processes a large amount of a silver halide photographic light-sensitive material, for example, by automatic-developing processors, in order to avoid a change in the finished photographic characteristics caused by the change in the concentrations of the components, some means is required to keep the concentrations of the components of the color developer within certain ranges.

For instance, a developer solution in a processor tank can be maintained at a 'steady-state concentration' by the use of another solution that is called the replenisher solution. By metering the replenisher solution into the tank at a rate proportional to the amount of the photographic light-sensitive material being developed, components can be maintained at an equilibrium within a concentration range that will give good performance. For the components that are consumed, such as the developing agents and preservatives, the replenisher solution is prepared with the component at a concentration higher than the tank concentration. In some cases a material will leave the emulsions layers that will have an effect of restraining development, and will be present at a lower concentration in the replenisher or not present at all. In other cases a material may be contained in a replenisher in order to remove the influence of a materials that will wash out of the photographic light-sensitive material. In other cases, for example, the buffer, or the concentration of a chelating agent where there may be no consumption, the component in the replenisher is the same or similar concentration as in the processor tank. Typically the replenisher has a higher pH to account for the acid that is released during development and coupling reactions so that the tank pH can be maintained at an optimum value.

Similarly, replenishers are also designed for the secondary bleach, fixer, and stabilizer solutions. In addition to additions for components that are consumed, components are added to compensate for the dilution of the tank which occurs when the previous solution is carried into the tank by the photographic light-sensitive material.

The following processing steps may be included in the preferable processing steps carried out in the method in which a processing solution is applied:

1) color developing→bleach-fixing→washing/stabilizing;
2) color developing→bleaching→fixing→washing/stabilizing;
3) color developing→bleaching→bleach-fixing→washing/stabilizing;
4) color developing→stopping→washing→bleaching→washing→fixing→washing/stabilizing;
5) color developing→bleach-fixing→fixing→washing/stabilizing;
6) color developing→bleaching→bleach-fixing→fixing→washing/stabilizing.

Among the processing steps indicated above, the steps 1) and 2) are preferably applied. Additionally, each of the steps indicated can be used with multistage applications as described in Hahm, U.S. Pat. No. 4,719,173, with co-current, counter-current, and contraco arrangements for replenishment and operation of the multistage processor.

The color developing solution used with this photographic element may contain aromatic primary amine color developing agents, which are well known and widely used in a variety of color photographic processes. Preferred examples are p-phenylenediamine derivatives. They are usually added to the formulation in a salt form, such as the hydrochloride, sulfate, sulfite, p-toluene-sulfonate, as the salt form is more stable and has a higher aqueous solubility than the free amine. Among the salts listed, the p-toluenesulfonate is rather useful from the viewpoint of making a color developing agent highly concentrated. Representative examples are given below, but they are not meant to limit what could be used with the present photographic element:

4-amino-3-methyl-N-ethyl-N-(β-hydroxyethyl)aniline sulfate, 4-amino-3-methyl-N-ethyl-N-(β-(methanesulfonamidoethyl)aniline sesquisulfate hydrate, 4-amino-N,N-diethylaniline hydrochloride, 4-amino-3-methyl-N,N-diethylaniline hydrochloride, 4-amino-3-β5-(methanesulfonamido)ethyl-N,N-diethylaniline hydrochloride and 4-amino-N-ethyl-N-(2-methoxyethyl)-m-toluidine di-p-toluene sulfonic acid.

Among the above-mentioned color developing agents, 4-amino-3-methyl-N-ethyl-N-(β-(methanesulfonamidoethyl)aniline sesquisulfate hydrate preferably is used. There may be some instances where the above-mentioned color developing agents may be used in combination so that they meet the purposes of the application.

Any photographic processor known to the art can be used to process the photosensitive materials described herein. For instance, large volume processors and so-called minilab and microlab processors may be used. Particularly, advantageous would be the use of Low Volume Thin Tank processors as described in the following references: WO 92/10790; WO 92/17819; WO 93/04404; WO 92/17370; WO 91/19226; WO 91/12567; WO 92/07302; WO 93/00612; WO 92/07301; WO 92/09932; U.S. Pat. No. 5,294,956; EP 559,027; U.S. Pat. No. 5,179,404; EP 559,025; U.S. Pat. No. 5,270,762; EP 559,026; U.S. Pat. Nos. 5,313,243; and 5,339,131.

For the reasons mentioned above, silver halide emulsions with greater than 90 mole % chloride are preferred, and even more preferred are emulsions of greater than 95 mole % chloride. In some instances, silver chloride emulsions containing small amounts of bromide, or iodide, or bromide and iodide are preferred, generally less than 5.0 mole % of bromide less than 2.0 mole % of iodide. In addition, the inclusion of substantial amounts of bromide and/or iodide would tend to reduce the developability of the emulsion, and thereby reduce the magnitude of the inventive effect.

3. Design of the Metadata Reading Sensor

The response of the system is predicated upon the ability of the sensor to detect the embedded, invisible code mixed with the pictorial information in the picture. To accomplish this, the sensor must discriminate the metadata signal from whatever pictorial information is present. In the instance where the pictorial information is represented in a reflection color or B/W photograph, the invisible information is only invisible to the human eye, but since it is present as an infrared adsorbing dye, the sensor must first distinguish visible light from infrared light. Visible light is generally considered to be light in the 400 nm to 700 mn of the spectrum. The near-infrared region of the spectrum begins at about 700 nm and extends past 900 nm. To aid the sensor's ability to distinguish visible from infrared light, an infrared cutoff filter can be included in the sensor design. An example of a filter of this type would be the WR-88A filter, which is commercially available from a variety of suppliers, including the Eastman Kodak Co., and a description of the absorption characteristics as a function of wavelength is also available.

The sensor detects infrared light reflected from the photograph. To achieve this, the sensor must first illuminate the photograph with infrared light. Therefore, in addition to the sensor having a device which senses infrared light, it must also contain a light source, which produces inrared light and which can be focused onto the photograph. A variety of light sources are available which emit light between 700 nm and 900 nm or beyond. Common tungsten lamps are once such examples, as are quartz-halogen bulbs. The spectral power distributions of the lamps are also widely published.

The actual infrared detector in the sensor is also commercially available. In the design used here, a 1-M pixel CMOS, or CCD array, manufactured by the Eastman Kodak Company is selected. Its spectral response characteristics are known and have been characterized in the 700 nm to 900 nm region.

When, in operation, the sensor is pointed at the picture containing the infrared metadata image, and the user triggers the sensor to flash the picture with infrared light. This action triggers the IR-lamp to flash and signals the CMOS or CCD sensor to record the reflected IR light from the image as a 2-dimensional array. The loss of intensity of reflected light by the array detector is proportional to the amount of IR dye formed in the $4^{th}$ sensitized layer of the photographic element.

The magnitude of the signal reflected by the image and received by the sensor is the cascaded combination of the illuminance output of the exposing IR light source of the sensor as a fimction of wavelength, $I(\lambda)$, the transmittance filter or combination of filters place in front of the sensor to filter out the visible light and improve image discrimination, $F(\lambda)$, the efficiency response of the CMOS or CCD array detector, in arbitrary response units, $D(\lambda)$, and the reflectance of the image in the photograph, $R_i(\lambda)$. The reflectance from the image is the combination of the reflectance of the coated paper base $R_b(\lambda)$ plus the reflectance's of the cyan, $R_C(\lambda)$, magenta, $R_M(\lambda)$, yellow $R_Y(\lambda)$ image dyes and the infrared $R_{IR}(\lambda)$, dye.

$$R_i(\lambda)=R_b(\lambda)+R_C(\lambda)+R_M(\lambda)+R_Y(\lambda)+R_{IR}(\lambda) \quad \text{Equation (1)}$$

Thus;

Therefore, the response of the sensor is proportional to the quantity, or brightness, (B) of the reflected light from the print in the following manner:

$$B=\int_{(700\text{-}900\ nm)} I(\lambda)*F(\lambda)*D(\lambda)*R_i(\lambda) \quad \text{Equation (2)}$$

Where the brightness, B, is the integral, as a function of wavelength, between 700 nm and 900 nm of the product of the intensity of the illuminant, the combination of any cutoff filters in the system, the response of the detector, and the reflectance of the image.

The combination of image dyes and the infrared dye in the image modulate the brightness of the reflected IR light from the sensor. Careful selection of the cutoff filter used in front of the sensor can simplify the image discrimination problem by essentially eliminating all the reflected light below the cutoff of the filter. In practice, a filter such as a WR88A transmits only 1.1% of light below 720 nm. In essence then, this filter eliminates the brightness contributions of the yellow and magenta image dyes to the signal. However, cyan dyes, which are designed to absorb red light (600 to 700 nm) do have an absorption band that tails into the near infrared portion of the spectrum.

The brightness of the signal is then modulated by the amounts of cyan and infrared image dye in the image. These amounts change as a function of spatial location in the image, as well as image content and metadata content. Since the situation exists where the cyan image dye tails into the infrared and the infrared dye tails into the visible portions of the spectrum, there is a need to co-optimize the cyan and infrared image dyes so that the contributions of the cyan dye to the infrared image and the contribution of the infrared dye to the visible image are minimized.

Two situations describe the extremes of the conditions: The first situation occurs when no cyan image dye is mixed with the infrared dye. The modulation of the brightness of the signal from the sensor then is solely due to the changing amount of infrared dye, and when no infrared dye is present, the brightness is maximized. This condition is defined as $$B=B_0 \quad \text{Equation (3)}$$

The second extreme situation exists when the amount of cyan image dye present in the image is at a maximum amount. In reflection prints, the cyan image dye rarely exceeds a density of 2.0. In this case, 1% of the incident light is reflected. However, in the near infrared portion of the spectrum, the unwanted absorptions of the cyan dye do not reach this density. The density achieved by the cyan in the infrared is highly dependent upon the selection of the chemical composition and structure of the dye as discussed earlier. In this situation, the brightness of the image as seen by the sensor is defined as $$B=B_{max} \quad \text{Equation (4)}$$

The signal to noise ratio of the system, in decibels, is $$S/N=10*\log(B/B_0) \quad \text{Equation (5)}$$

The overall design of the system requires that the signal to noise ratio be maximized. Since 1 dB is defined as a "just noticeable difference", a difference of 2 dB could be considered as a 'more than significant' difference. To achieve this, the contribution of the cyan dye to the infrared portion of the signal is minimized, the infrared signal is maximized, and the contribution of the infrared dye to the image portion of the picture is minimized.

Figure 2:
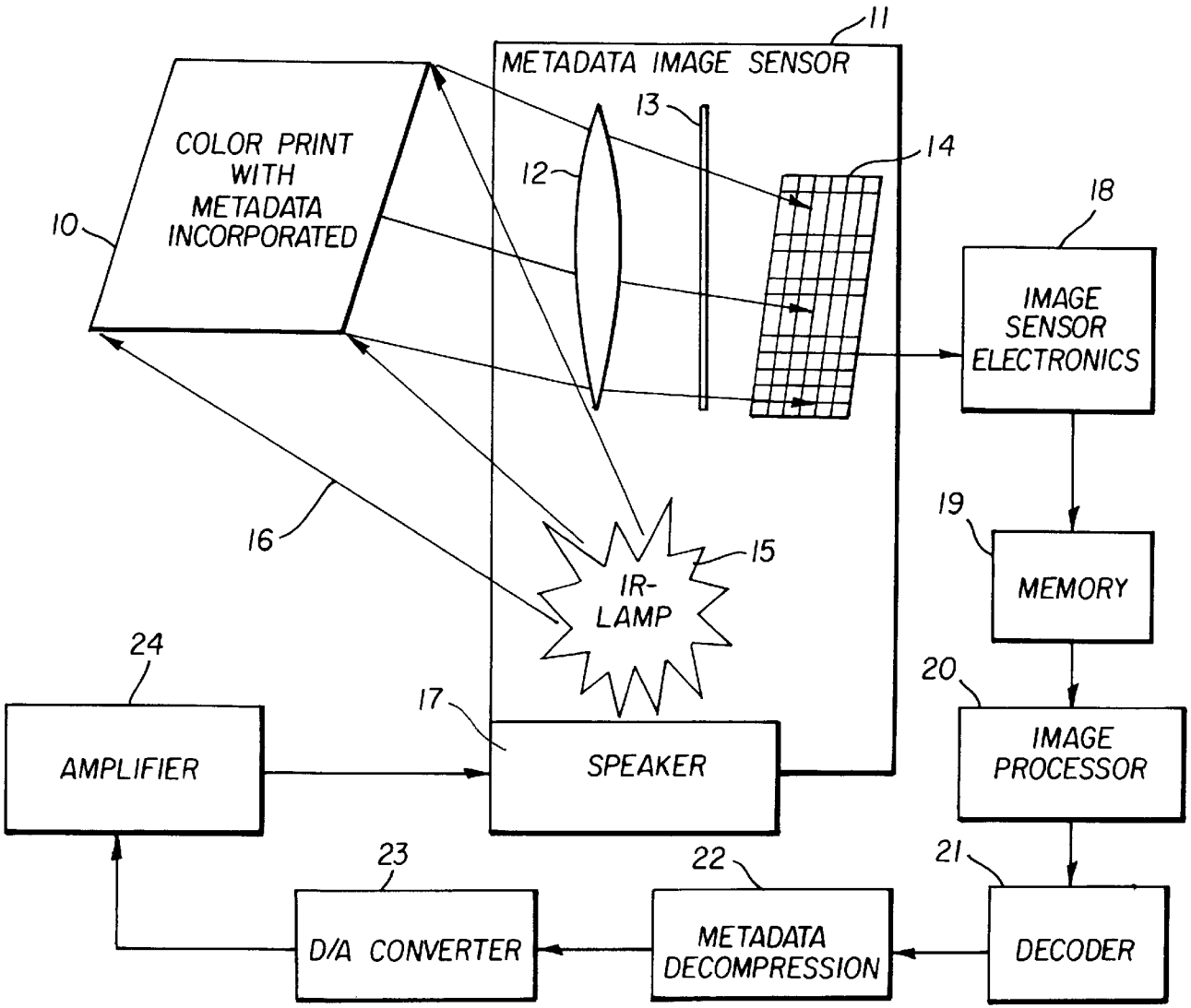
FIG. 2 is a schematic diagram of a hand held reader and its elements within that sense the invisible metadata image in the picture, reads the signal, decodes the information, and then reproduces it as sound through a speaker.

Referring to FIG. 2, the image containing the invisible metadata (10) is first exposed to a flash of infrared light (16) from the metadata sensor (11). The infrared light illuminates the image wherein any encoded metadata modulates the light and the non-modulated light is reflected back to the sensor through a lens (12) which focuses the light through a filter (13) or combination of filters and onto a CMOS or CCD detector (14). Associated with the image sensor are the image sensor electronics (18) that control reading the individual pixels and response characteristics of the detector. Optionally, the output of the image sensor can be temporarily stored in memory (19) before being processed by the metadata image processor (20). The metadata image is then decoded (21), decompressed (22), converted to an analogue signal by the D/A converter (23), amplified (24), and subsequently reproduced as an audio file by a speaker (17), incorporated into the sensor.

It is intended that the sensor be wholly contained and is designed to be a hand-held device, within which is contained the lens (12), filters (13), sensor (14), IR flash lamp (15), image sensor electronics (18), storage memory (19), image processor (20), decoding electronics (21), metadata decompression (22), D/A converter (23), amplifier (24), and speaker (17). The unit also contains the necessary power supplies (not depicted) to power the IR flash lamp and related image sensor electronics, as well as the output and speaker power supplies.

The unit collects the infrared light reflected from the picture image when the user triggers the IR lamp. The collected light is focussed through the lens or combination of lenses through the filter or combination of filters. The filters pass the IR light and screen out any visible light. The light is then imaged onto the CMOS or CCD sensor so that a pixel by pixel image of the photograph is obtained. Triggering the IR flash lamp simultaneously triggers the circuitry and electronics of the 2-D sensor to an initial state so that the resultant, captured 25 metadata image can be stored in memory, then processed by the image processor to 'frame', spatially orient, correct for blur and assign code values for the signals of each pixel. This encoded information is then passed to the decoder circuit, which interprets the digital signals back into the metadata form where they were originally captured in. The signals are subsequently decompressed and expanded to their original size and length, then converted back to their analogue counterparts, amplified and reproduced through an integrated speaker assembly.

The following examples illustrate the practice of this invention. They are not intended to be exhaustive of all possible variations of the invention. Parts and percentages are by weight unless otherwise indicated.

EXAMPLES

Photographic Examples

Example 1

Single Layer Coating Containing a Red Sensitized Emulsion

A silver chloride emulsion was chemically and spectrally sensitized as is described below.

Red Sensitive Emulsion (Red EM-1): A high chloride silver halide emulsion was precipitated by adding approximately equimolar silver nitrate and sodium chloride solutions into a well-stirred reactor containing gelatin peptizer and thioether ripener. The resultant emulsion contained cubic shaped grains of 0.40 $\mu$m in edge length. In addition, ruthenium hexacyanide dopant (at 16.5 mg/Ag-M) and $K_2IrCl_5$(5-methylthiazole) dopant (at 0.99 mg/Ag-M) were added during the precipitation process. This emulsion was optimally sensitized by the addition of a colloidal suspension of aurous sulfide (60 mg/Ag-M) followed by a heat ramp to 65° C. for 45 minutes, and fuirther additions of 1-(3-acetamidophenyl)-5-mercaptotetrazole (295 mg/Ag-M), iridium dopant $K_2IrCl_6$ (149 $\mu$g/Ag-M), potassium bromide (0.5 Ag-M %), and red sensitizing dye RSD-1 (7.1 mg/Ag-M).

Dispersions of couplers C-1 to C-5, were emulsified by methods well known to the art, and were coated on the face side of a doubly extruded polyethylene coated color paper support using conventional coating techniques. The gelatin layers were hardened with bis (vinylsulfonyl methyl) ether at 2.4 % of the total gelatin. The composition of the individual layers is given as follows:

Single Layer Coating Evaluation Format:

The emulsion described above was first evaluated in a single emulsion layer-coating format using conventional coating preparation methods and techniques. This coating format is described below in detail:

TABLE 1

Single Layer Coating Format

| Layer | Coating Material | Coverage mg/m$^2$ |
|---|---|---|
| Overcoat | Gelatin | 1064. |
| | Gel hardener | 105. |
| Imaging | Emulsion Ked EM-1 | 215.3 |
| | Couplers C-1 to C-5 | 431. |
| | Gelatin | 1658. |
| Adhesion sub-layer | Gelatin | 3192. |
| Polyethylene coated paper support | | |

Once the coated paper samples described above had been prepared, they were given a preliminary evaluation as follows:

The respective paper samples were exposed in a Kodak Model 1B sensitometer with a color temperature of 3000° K and filtered with a Kodak Wratten™ 2C plus a Kodak Wratten™ 29 filter and a Hoya HA-50. exposure time was adjusted to 0.1 seconds. The exposures were performed by contacting the paper samples with a neutral density step exposure tablet having an exposure range of 0 to 3 log-E.

The paper samples described above as coating examples 1 to 5 were processed in the Kodak Ektacolor RA-4 Color Developmentrm process. The color developer and bleach-fix formulations are described below in Table 2 and Table 3. The chemical development process cycle is described in Table 4.

TABLE 2

Kodak Ektacolor ™ RA-4 Color Developer

| Chemical | Grams/Liter |
|---|---|
| Triethanol amine | 12.41 |
| Phorwite REU ™ | 2.30 |
| Lithium polystyrene sulfonate (30%) | 0.30 |
| N,N-diethylhydroxylamine (85%) | 5.40 |
| Lithium sulfate | 2.70 |
| Kodak Color developer CD-3 | 5.00 |
| DBQUEST 2010 ™ (60%) | 1.16 |
| Potassium carbonate | 21.16 |
| Potassium bicarbonate | 2.79 |
| Potassium chloride | 1.60 |
| Potassium bromide | 0.007 |
| Water | to make 1 liter |

pH @ 26.7° C. is 10.04 +/−0.05

TABLE 3

Kodak Ektacolor ™ RA-4 Bleach-Fix

| Chemical | Grams/Liter |
|---|---|
| Ammonium thiosulfate (56.5%) | 127.40 |
| Sodium metabisulfite | 10.00 |
| Glacial acetic acid | 10.20 |
| Ammonium ferric EDTA (44%) | 110.40 |
| Water | to make 1 liter |

pH @ 26.7° C. is 5.5 +/−0.10

TABLE 4

Kodak Ektacolor ™ RA-4 Color Paper Process

| Process Step | Time (seconds) |
|---|---|
| Color Development | 45 |
| Bleach-fix | 45 |
| Wash | 90 |
| Dry | |

Processing the exposed paper samples is performed with the developer and bleach-fix temperatures adjusted to 35° C. Washing is performed with tap water at 32.2° C.

To facilitate comparisons, the characteristic vector, also determined from principle component analysis, was determined using standard characterization methods since the absorption characteristics of a given colorant will vary to some extent with a change in colorant amount. This is due to factors such as measurement flare, colorant-colorant interaction, colorant-support interactions, colorant concentration effects, and the presence of color impurities in the media. However, by using characteristic vector analysis, one can determine a characteristic absorption curve that is representative of the absorption characteristics of the colorant over the complete wavelength and density ranges of interest. This technique is described by J. L. Simonds in the Journal of the Optical Society of America, 53(8), 968–974, 1963.

The $\lambda$-max (normalized to 1.0 density) of the characteristic vector of each dye and the density of each dye vectors were measured at 700 nm and are given in the following table:

TABLE 5

| Sample | Coupler | λ-max of Dye Vector @ 1.0 Density | Density at 700 nm |
|---|---|---|---|
| 1 | C-1 | 660 nm | 0.73 |
| 2 | C-2 | 630 nm | 0.33 |
| 3 | C-3 | 690 nm | 0.99 |
| 4 | C-4 | 710 nm | 0.99 |
| 5 | C-5 | 740 nm | 0.83 |

The data in Table 5 show that cyan dye forming couplers C-1 and C-2 absorb light in the red region of the visible spectra which is generally defined as the region between 600 to 700 nm. Because of the shape of the absorption bands of the dyes they also absorb infrared light as evidenced by the amount of density at 700 nin Coupler C-3 has an absorption band that falls across both the far-red and near-infrared region. Couplers C-4 and C-5 are illustrative of couplers, which form dyes that primarily absorb in the infrared region since their absorption maxima are beyond 700 nmn.

Example 2

Multilayer Coating

Silver chloride emulsions were chemically and spectrally sensitized as is described below.

Blue Sensitive Emulsion (Blue EM-2, prepared as described in U.S. Pat. No. 5,252,451, column 8, lines 55–68): A high chloride silver halide emulsion was precipitated by adding approximately equimolar silver nitrate and sodium chloride solutions into a well-stirred reactor containing gelatin peptizer and thioether ripener. $Cs_2Os(NO)Cl_5$(136 μg/Ag-M) and $K_2IrCl_5$(5-methylthiazole) (72 μg/Ag-M), dopants were added during the silver halide grain formation for most of the precipitation. At 90% of the grain volume, precipitation was halted and a quantity of potassium iodide was added, equivalent to 0.2 M % of the total amount of silver. After addition, the precipitation was completed with the addition of additional silver nitrate and sodium chloride and subsequently followed by a shelling without dopant. The resultant emulsion contained cubic shaped grains of 0.60 μm in edge length. This emulsion was optimally sensitized by the addition of a colloidal suspension of aurous sulfide (18.4 mg/Ag-M) and heat ramped up to 60° C. during which time blue sensitizing dye BSD-4, (388 mg/Ag-M), 1-(3-acetamidophenyl)-5-mercaptotetrazole (93 mg/Ag-M) and potassium bromide (0.5 M %) were added. In addition, iridium dopant $K_2IrCl_6$ (7.4 μg/Ag-M) was added during the sensitization process.

Green Sensitive Emulsion (Green EM-1): A high chloride silver halide emulsion was precipitated by adding approximately equimolar silver nitrate and sodium chloride solutions into a well-stirred reactor containing gelatin peptizer and thioether ripener. $Cs_2Os(NO)Cl_5$(1.36 μg/Ag-M) dopant and $K_2IrCl_5$(5-methylthiazole) (0.54 mg/Ag-M) dopant were added during the silver halide grain formation for most of the precipitation, followed by a shelling without dopant. The resultant emulsion contained cubic shaped grains of 0.30 μm in edge length. This emulsion was optimally sensitized by addition of a colloidal suspension of aurous sulfide (12.3 mg/Ag-M), heat digestion, followed by the addition of silver bromide (0.8 M%), green sensitizing dye, GSD-1 (427 mg/Ag-M), and 1-(3-acetamidophenyl)-5-mercaptotetrazole (96 mg/Ag-M).

Infrared Sensitive Emulsion (FS EM-1): A high chloride silver halide emulsion was precipitated by adding approximately equimolar silver nitrate and sodium chloride solutions into a well-stirred reactor containing gelatin peptizer and thioether ripener. The resultant emulsion contained cubic shaped grains of 0.40 μg in edge length. In addition, ruthenium hexacyanide dopant (at 16.5 mg/Ag-M) and $K_2IrCl_5$(5-methylthiazole) dopant (at 0.99 mg/Ag-M) were added during the precipitation process. This emulsion was optimally sensitized by the addition of a colloidal suspension of aurous sulfide (60. mglAg-M) followed by a heat ramp to 65° C. for 45 minutes, followed by further additions of antifoggant, 1-(3-acetamidophenyl)-5-mercaptotetrazole (295. mg/Ag-M), iridium dopant ($K_2IrCl_6$ at 149. μg/Ag-M), potassium bromide (0.5 Ag-M %), DYE-5 (300 mg/Ag-M), infrared sensitizing dye IRSD-1 (33.0 mg/Ag-M) and fmally, after the emulsion was cooled to 40° C., DYE-4 (10.76 mg/$M^2$).

Infrared Sensitive Emulsion (FS EM-2): A high chloride silver halide emulsion was precipitated by adding approximately equimolar silver nitrate and sodium chloride solutions into a well-stirred reactor containing gelatin peptizer and thioether ripener. The resultant emulsion contained cubic shaped grains of 0.40 μg in edge length. In addition, ruthenium hexacyanide dopant (at 16.5 mg/Ag-M) and $K_2IrCl_5$(5-methylthiazole) dopant (at 0.99 mg/Ag-M) were added during the precipitation process. This emulsion was optimally sensitized by the addition of a colloidal suspension of aurous sulfide (60. mg/Ag-M) followed by a heat ramp to 65° C. for 45 minutes, followed by fuirther additions of antifoggant, 1-(3-acetamidophenyl)-5-mercaptotetrazole (295. mg/Ag-M), iridium dopant $K_2IrCl_6$ (149. μg/Ag-M), potassium bromide (0.5 Ag-M %), DYE-5 (300 mg/Ag-M), infrared sensitizing dye IRSD-2 (33.0 mg/Ag-M) and finally, after the emulsion was cooled to 40° C., DYE4 (10.76 mg/$M^2$).

Infrared Sensitive Emulsion (FS EM-3): A high chloride silver halide emulsion was precipitated by adding approximately equimolar silver nitrate and sodium chloride solutions into a well-stirred reactor containing gelatin peptizer and thioether ripener. The resultant emulsion contained cubic shaped grains of 0.40 μg in edge length. In addition, ruthenium hexacyanide dopant (16.5 mg/Ag-M) and $K_2IrCl_5$ (5-methylthiazole) dopant (0.99 mg/Ag-M) were added during the precipitation process. This emulsion was optimally sensitized by the addition of a colloidal suspension of aurous sulfide (60. mg/Ag-M) followed by a heat ramp to 65° C. for 45 minutes, followed by fuirther additions of antifoggant, 1-(3-acetamidophenyl)-5-mercaptotetrazole (295. mg/Ag-M), iridium dopant $K_2IrCl_6$ (149. μg/Ag-M), potassium bromide (0.5 Ag-M %), DYE-5 (300 mg/Ag-M), infrared sensitizing dye IRSD-3 (33.0 mg/Ag-M) and finally, after the emulsion was cooled to 40° C., DYE-4 (10.76 mg/$M^2$).

Infrared Sensitive Emulsion (FS EM-4): A high chloride silver halide emulsion was precipitated by adding approximately equimolar silver nitrate and sodium chloride solutions into a well-stirred reactor containing gelatin peptizer and thioether ripener. The resultant emulsion contained cubic shaped grains of 0.40 μg in edge length. In addition, ruthenium hexacyanide dopant (at 16.5 mg/Ag-M) and $K_2IrCl_5$(5-methylthiazole) dopant (0.99 mg/Ag-M) were added during the precipitation process. This emulsion was optimally sensitized by the addition of a colloidal suspension of aurous sulfide (60. mg/Ag-M) followed by a heat ramp to 65° C. for 45 minutes, followed by further additions of antifoggant, 1-(3-acetamidophenyl)-5-mercaptotetrazole (295. mg/Ag-M), iridium dopant $K_2IrCl_6$ (149. μg/Ag-M), potassium bromide (0.5 Ag-M %), DYE-5 (300 mg/Ag-M), infrared sensitizing dye IRSD-4 (33.0 mg/Ag-M) and finally, after the emulsion was cooled to 40° C., DYE-4 (10.76 mg/$M^2$).

Table 6, illustrates a conventional layer order for color negative papers such as Kodak Ektacolor Paper™. Inclusion of a $4^{th}$ sensitized layer requires not only the addition of the $4^{th}$ sensitized layer, but also adjacent interlayers to scavenge oxidized developer which may migrate from the $4^{th}$ sensitized layer to an adjacent imaging layer or, conversely, from an adjacent imaging layer to the metadata recording layer. A coating structure for this composition is illustrated in Table 7. The composition of the individual layers for either structure is given in Table 8.

TABLE 6

| Conventional Structure |
|---|
| Overcoat |
| UV absorbing Layer |
| Red light sensitive layer |
| Interlayer |
| Green light sensitive layer |
| Interlayer |
| Blue light sensitive layer |
| Support |

TABLE 7

| Inventive Structure #1 |
|---|
| Overcoat |
| UV absorbing layer |
| Red light sensitive layer |
| Interlayer |
| Green light sensitive layer |
| Interlayer |
| Blue light sensitive layer |
| Interlayer |
| $4^{th}$ Sensitized Layer containing an IR Dye forming Coupler |
| Support |

TABLE 8

| Composition of the Photographic Elements | g/m$^2$ |
|---|---|
| OC: Simultaneous Overcoat | |
| Gelatin | 0.645 |
| Dow Coming DC200 | 0.0202 |
| Ludox AM | 0.1614 |
| Di-t-octyl hydroquinone | 0.013 |
| Dibutyl phthalate | 0.039 |
| SF-1 | 0.009 |
| SF-2 | 0.004 |
| UV: UV light Absorbing Layer | |
| Gelatin | 0.624 |
| Tinuvin 328 | 0.156 |
| Tinuvin 326 | 0.027 |
| Di-t-octyl hydroquinone | 0.0485 |
| Cyclohexane-dimethanol-bis-2-ethylhexanoic | 0.18 |
| Di-n-butyl phthalate | 0.18 |
| RL: Red Sensitive Layer | |
| Gelatin | 1.356 |
| Red Sensitive Silver (Red EM-1) | 0.194 |
| C-1 or | 0.381 |
| C-2 | 0.237 |
| Dibutyl phthalate | 0.381 |
| UV-2 | 0.245 |
| 2-(2-butoxyethoxy)ethyl acetate | 0.0312 |
| Di-t-octyl hydroquinone | 0.0035 |
| DYE-3 | 0.0665 |

TABLE 8-continued

| Composition of the Photographic Elements | g/m$^2$ |
|---|---|
| aIR: 4th Sensitive Layer | |
| Gelatin | 1.076 |
| 4th Sensitive Silver (FS-EM-1, or 2, or 3, or 4) | 0.043 |
| C-3 or C-4 or C-5 | 0.0516 |
| Di-n-butyl phthalate | 0.0258 |
| 2-(2-butoxyethoxy)ethyl acetate | 0.0129 |
| GL: Green Sensitive Layer | |
| Gelatin | 1.421 |
| Green Sensitive Silver | 0.0785 |
| M-2 | 0.238 |
| Dibutyl phthalate | 0.0846 |
| DUP | 0.0362 |
| ST-8 | 0.181 |
| ST-21 | 0.064 |
| ST-22 | 0.604 |
| 1-Phenyl-5-mercaptotetrazole | 0.0001 |
| DYE-2 | 0.0602 |
| BL-1: Blue Sensitive Layer | |
| Gelatin | 1.312 |
| Blue Sensitive Silver (Blue EM-2) | 0.227 |
| Y-5 | 0.414 |
| P-1 | 0.414 |
| Dibutyl phthalate | 0.186 |
| 1-Phenyl-5-mercaptotetrazole | 0.0001 |
| DYE-1 | 0.009 |

Couplers C-1 or C-2 were coated as the cyan imaging coupler in the red sensitive record, RL. The $4^{th}$ sensitized layer, IR, was made sensitive to infrared light by the presence of the infiared sensitizing dyes IRSD-1 or 2 or 3 or 4 on emulsions FS-EM-1 or FS-EM-2 or FS-EM-3 or FS-EM-4 respectively. These emulsions were coated in combination with either coupler C-3, CA, or C-5 to generate various multilayer combination examples. Depending upon the selection of the emulsion for the $4^{th}$ sensitized layer, the element has one of the following spectral sensitivities as given in Table 9. The selection of sensitization for the $4^{th}$ record is not critical to the invention. The important criterion for the design of the system is that the spectral sensitization of the $4^{th}$ element not substantially overlap the sensitization of any of the three imaging records. Generally, a 50 nm difference between the peak sensitivities of the various spectral sensitizing dyes is sufficient, so that when combined with the inherent emulsion efficiencies, absorber dyes in the element and power output and wavelength of the exposing device, an adequate level of exposure can be achieved which is unique and distinct from the other sensitized records.

TABLE 9

| Spectral Sensitivities of the Photographic Element | | |
|---|---|---|
| Emulsion | Sensitizing Dye | Peak Spectral Sensitivity |
| Blue EM-2 | BSD-4 | 473 nm |
| Green EM-1 | GSD-1 | 550 nm |
| Red EM-1 | RSD-1 | 695 nm |
| FS-EM-1 | IRSD-1 | 765 nm |
| Or FS-EM-2 | IRSD-2 | 765 nm |
| Or FS-EM-3 | IRSD-3 | 810 nm |
| Or FS-EM-4 | IRSD-4 | 750 nm |

Subsequently, the cascaded system brightness (B) was determined. In the samples below, the density of the cyan image was varied from 0 to 2, by increasing the amount of red light exposure from the printer. A similar process was used to expose samples 6—9 except the $4^{th}$ light source in the printer was an infrared laser diode to match the spectral sensitivity of the element as described in the table above. After exposure and development, the brightness of the image was determined as described earlier. In all of the following examples, the illumination source was a halogen-lamp and the filter of the 1 M-pixel sensor was a WR-88A. The following brightness (B) results were obtained and are given in Table 10:

TABLE 10

Cascaded System Brightness Levels as a Function of Cyan or Infrared Dye Density

| Sample | Dye Density/Dye | Cascaded System Brightness (B) (arbitrary response units) D = 0.0 | D = 0.5 | D = 1.0 | D = 1.5 | D = 2.0 |
|---|---|---|---|---|---|---|
| 6 | C-1 (Comparative) | 2.02 | 1.85 | 1.68 | 1.55 | 1.43 |
| 7 | C-3 | 2.02 | 1.48 | 1.15 | 0.94 | 0.80 |
| 8 | C-4 | 2.02 | 1.33 | 0.95 | 0.73 | 0.59 |
| 9 | C-5 | 2.02 | 1.15 | 0.73 | 0.51 | 0.38 |

The data in Table 10 show that when none of the dyes are formed in the element, the brightness of the system is 2.02. As the amount of exposure is increased in any example, the brightness of the system is diminished. If all of the reflected infrared light had been adsorbed by the dye, the brightness would have been reduced to zero. The dye from the cyan image coupler C-1 shows only a modest ability to reduce the level of brightness over its density range of 0 to 2.0 since its bathochromic absorption band only modestly extends into the infrared. Coupler C-3, which forms a dye having a peak absorption in the long red spectral region and some absorption in the IR, shows an increasing ability to modulate the system brightness as its density is increased. The infrared dye forming couplers C-4 and C-5 produce dyes which demonstrate the greatest amount of image brightness modulation as a fiuction of increasing dye density.

For efficient system design it is desirable to minimize the amount of coupler and silver used to form the IR dye while maximizing the brightness modulation. The brightness modulation of each dye can be approximated by the signal to noise ratio of the system as a function of image dye and infrared dye density. The data in the following table show the image brightness modulation of each dye as a fuinction of its density, and the result is expressed as the signal to noise ratio (S/N) ratio in dB:

TABLE 11

System Signal to Noise Ratio as a Function of Dye Density

| Sample | Dye Density/Dye | Signal to Noise Ratio (dB) D = 0.0 | D = 0.5 | D = 1.0 | D = 1.5 | D = 2.0 |
|---|---|---|---|---|---|---|
| 6 | C-1 (Comparative) | 0.0 | −0.41 | −0.80 | −1.15 | −1.50 |
| 7 | C-3 | 0.0 | −1.35 | −2.45 | −3.32 | −4.02 |

TABLE 11-continued

System Signal to Noise Ratio as a Function of Dye Density

| Sample | Dye Density/Dye | Signal to Noise Ratio (dB) D = 0.0 | D = 0.5 | D = 1.0 | D = 1.5 | D = 2.0 |
|---|---|---|---|---|---|---|
| 8 | C-4 | 0.0 | −1.81 | −3.28 | −4.42 | −5.34 |
| 9 | C-5 | 0.0 | −2.45 | −4.42 | −5.98 | −7.26 |

The data in this table show that even at a density of 2.0, the cyan imaging dye C-1 in the system does provide a S/N reduction of −2.0. The IR dye forming couplers C-3 to C-5 can each reach this level of noise suppression, but at different densities of dye. The most efficient of which is C-5 achieves this level of noise reduction at a density of less than 0.5.

The amount of IR dye density required to produce a S/N level of 2 is lowest when there is not any cyan image dye with which to contend. The vast majority of photographic images contain cyan dye in amounts that vary as a function of image content, and almost never exceed a density of 2.0 in the Dmax area of an image, or below 0.1 in the Dmin of an image. Thus, any system designed to discriminate the brightness of the IR reflectance from any amount of cyan image dye must do so over a wide range of cyan dye densities.

To assess the interaction between the cyan image dye and the infrared image dye, samples 6–9 were given red and infrared light exposures to simulate images that contain both the red and infrared dyes. The exposures were varied in such a way that after development, both the cyan and IR dyes were formed in the element. We then determined the amount of IR dye density required to provide a S/N reduction of 2.0 dB as a function of cyan image dye density.

The results are given in the following table and show that as the amount of cyan image dye increases, the amount of IR dye required to produce the same 2.0 dB S/N ratio increases as a function of IR dye, but varies as a function of IR dye type. Once again, the dye from coupler C-5 is preferred, as only a density of 0.46 is required compared to a density of 0.99 from the dye formed by coupler C-3.

TABLE 12

Density of IR Dye Required to Produce a 2.0 dB SIN Ratio in Combination with Changing Densities of Cyan Image Dye, C-1

| Density of C-1 (Comparative) | Density of Dye from IR Dye Forming Coupler C-3 | C-4 | C-5 |
|---|---|---|---|
| 0.0 | 0.79 | 0.56 | 0.40 |
| 0.5 | 0.84 | 0.59 | 0.42 |
| 1.0 | 0.90 | 0.61 | 0.43 |
| 1.5 | 0.93 | 0.64 | 0.45 |
| 2.0 | 0.99 | 0.66 | 0.46 |

When the inventive image coupler, C-2, is coated in combination with any of the infrared dye forming couplers C-3 to C-5, the same analysis of the system brightness can be made as was done for cyan image coupler C-1, above. In Table 13, the cascaded system brightness by the dyes formed from the infrared couplers C-3 to C-5 are the same as reported in Table 10, since they are not changed. The brightness modulated by the dye formed from coupler C-2, is not as effective as that by comparative coupler C-1. When there is no image dye formed, the brightness level is at a maximum. At the highest dye level expected to be formed by the system, D=2.0, the brightness is reduced to a level of only 1.66. Comparative dye C-1 in Table 10 reduced the brightness level to 1.43 in comparison. Ideally, it is not desirable for the cyan image dye to modulate the brightness of the system, so the higher the brightness as a function of density, the better. If the cyan image dye did not modulate the brightness of the system at all, then the brightness at D=2.0 would equal the system brightness at D=0.0.

TABLE 13

Cascaded System Brightness Levels as a Function of Cyan or Infrared Dye Density

| | Dye | Cascaded System Brightness Level (B) (arbitrary response units) | | | | |
|---|---|---|---|---|---|---|
| Sample | Density/Dye | D = 0.0 | D = 0.5 | D = 1.0 | D = 1.5 | D = 2.0 |
| 10 | C-2 (Inventive) | 2.02 | 1.92 | 1.83 | 1.75 | 1.66 |
| 11 | C-3 | 2.02 | 1.48 | 1.15 | 0.94 | 0.80 |
| 12 | C-4 | 2.02 | 1.33 | 0.95 | 0.73 | 0.59 |
| 13 | C-5 | 2.02 | 1.15 | 0.73 | 0.51 | 0.38 |

The data presented in Table 14 is similar to that given inTtable 11, except that the inventive cyan coupler, C-2, was coated in RL in place of C-1. The dyes formed from infrared couplers C-3 to C-5 produce the same signal to noise ratios when they are formed without contribution from the cyan image dye. This information shows that the S/N ratio for the cyan image dye from coupler C-2 is worse than for coupler C-1 in Table 11. This is due to the differences in the bathochromic absorption of the two dyes.

TABLE 14

System Signal to Noise Ratio as a Function of Dye Density

| | Dye | Signal to Noise Ratio (dB) | | | | |
|---|---|---|---|---|---|---|
| Sample | Density/Dye | D = 0.0 | D = 0.5 | D = 1.0 | D = 1.5 | D = 2.0 |
| 10 | C-2 (Inventive) | 0.0 | −0.22 | −0.43 | −0.62 | −0.85 |
| 11 | C-3 | 0.0 | −1.35 | −2.45 | −3.32 | −4.02 |
| 12 | C-4 | 0.0 | −1.81 | −3.28 | −4.42 | −5.34 |
| 13 | C-5 | 0.0 | −2.45 | −4.42 | −5.98 | −7.26 |

To assess the interaction between the cyan image dye and the infrared image dye, Examples 10–13 were given red and infrared light exposures to simulate images that contain both the red and infiared dyes. The exposures were varied in such a way that after development, both the cyan and IR dyes were formed in the element. We then determined the amount of IR dye density required to provide a S/N reduction of 2.0 dB as a function of cyan image dye density for coupler C-2 in place of C-1.

The results are given in the Table 15 and show that as the amount of cyan image dye increases, the amount of IR dye required to produce the same 2.0 dB S/N ratio increases as a function of IR dye, but varies as a function of IR dye type. Once again, the dye from coupler C-5 is preferred, as only a density of 0.42 is required compared to a density of 0.84 from the dye formed by coupler C-3.

TABLE 15

Density of IR Dye Required to Produce a 2.0 dB S/N Ratio in Combination with Changing Densities of Cyan Image Dye, C-2

| Density of C-2 (Inventive) | Density of C-3 | Density of C-4 | Density of C-5 |
|---|---|---|---|
| 0.0 | 0.78 | 0.55 | 0.40 |
| 0.5 | 0.81 | 0.57 | 0.41 |
| 1.0 | 0.81 | 0.57 | 0.41 |
| 1.5 | 0.84 | 0.58 | 0.41 |
| 2.0 | 0.84 | 0.60 | 0.42 |

A comparison of the relative differences in the amounts of IR dye required to produce a 2.0 dB S/N ratio if cyan image coupler C-2 vs. coupler C-1 is used is given in Table 16. The information in this table shows that in each instance where cyan image dye is formed, that lower amounts of infrared dye forming coupler are required when dye formed from coupler C-2 is used compared to dye from coupler C-1. The impact of the difference is greatest when the least bathochromic dyes (i.e. C-3) are used to generate the infrared metadata image as compared to the more bathochromic dyes such as that formed from coupler C-5.

TABLE 16

Relative Amounts of IR Dye Required to Produce a 2.0 dB S/N Ratio for Cyan image Dyes, C-2 Compared to C-1

| | Percentage of IR Dye Required for Cyan Dye C-2 (Inventive) vs. Cyan Dye C-1 (Comparative) | | |
|---|---|---|---|
| Cyan Image Dye Density | Dye from Coupler C-3 | Dye from Coupler C-4 | Dye from Coupler C-5 |
| 0.0 | 99% | 98% | 100% |
| 0.5 | 96% | 97% | 98% |
| 1.0 | 90% | 93% | 95% |
| 1.5 | 90% | 91% | 91% |
| 2.0 | 85% | 91% | 91% |

The ability to reduce the amount of infrared dye forming coupler in the metadata layer, as well as to reduce the corresponding amount of silver halide needed to develop the metadata image, is significant. The capability to accomplish this is facilitated by the use of cyan image dye formers whose absorption bands on the bathochromic side are reduced. Preferred dyes are those whose normalized characteristic vectors have a corresponding density at 700 nm that is less than 0.4 and most preferably less than 0.35 and most preferably less than 0.2.

Of greatest significance is the recognition of the large difference in density required between digital metadata-sound images such as this and motion picture soundtrack images in order to produce adequate S/N ratios. Since motion picture soundtracks required densities of 3.0 or greater to produce hi-fidelity sound, the optimization of metadata-sound images such as described herein require densities of approximately 0.4; thus realizing a significant savings in manufacturing materials such as silver halide and coupler. Additionally, since the metadata image is overlaid spatially with the visual image information, the unwanted visual absorptions of the IR dyes can be further mnirimized by the reduced need to form high density images, thus further improving image quality.

Example 3

Silver chloride emulsions were chemically and spectrally sensitized as is described below.

Red Sensitive Emulsion (Red EM-2): A high chloride silver halide emulsion was precipitated by adding approximately equimolar silver nitrate and sodium chloride solutions into a well-stirred reactor containing gelatin peptizer and thioether ripener. The resultant emulsion contained cubic shaped grains of 0.40 μm in edge length. In addition, ruthenium hexacyanide dopant (at 16.5 mg/Ag-M) and $K_2IrCl_5$(5-methylthiazole) dopant (0.99 mg/Ag-M) were added during the precipitation process. This emulsion was optimally sensitized by the addition of a colloidal suspension of aurous sulfide (60 mg/Ag-M) followed by a heat ramp to 65° C. for 45 minutes, and further additions of 1-(3-acetamidophenyl)-5-mercaptotetrazole (295 mg/Ag-M), iridium dopant $K_2IrCl_6$ (149 μg/Ag-M), potassium bromide (0.5 Ag-M %), and sensitizing dye GSD-2 (8.9 mg/Ag-M).

Couplers C-1 or C-2 were coated as the cyan imaging coupler in the red sensitive record, RL. The $4^{th}$ sensitized layer, IR, was made sensitive to light in the spectral region between the red and green spectral sensitizing dyes by the presence of the short red sensitizing dye GSD-2, emulsion Red-EM-2. This emulsion was combined with either coupler C-3, C-4, or C-5 to generate the various multilayer combinations of photographic examples. This element has the following spectral sensitivities as given in Table 17:

TABLE 17

Spectral Sensitivities of the Photographic Element

| Emulsion | Sensitizing Dye | Peak Spectral Sensitivity |
|---|---|---|
| Blue EM-2 | BSD-4 | 473 nm |
| Green EM-1 | GSD-1 | 550 nm |
| Red EM-1 | RSD-1 | 695 nm |
| Red EM-2 | GSD-2 | 625 nm |

Results of the analysis of the elements formed in the example were similar to those described in Example 2, as only the spectral sensitization of the FS layer of the element was altered.

Example 4

Silver chloride emulsions were chemically and spectrally sensitized as is described below.

Blue Sensitive Emulsion (Blue EM-1, prepared as described in U.S. Pat. No. 5,252,451, column 8, lines 55–68): A high chloride silver halide emulsion was precipitated by adding approximately equimolar silver nitrate and sodium chloride solutions into a well-stirred reactor containing gelatin peptizer and thioether ripener. $Cs_2Os(NO)Cl_{5(136\ \mu g/Ag\text{-}M)}$ and $K_2{}^{IrCl}{}_5$(5-methylthiazole) (72 μg/Ag-M) dopants were added during the silver halide grain formation for most of the precipitation. At 90% of the grain volume, precipitation was halted and a quantity of potassium iodide was added, equivalent to 0.2 M % of the total amount of silver. After addition, the precipitation was completed with the addition of additional silver nitrate and sodium chloride and subsequently followed by a shelling without dopant. The resultant emulsion contained cubic shaped grains of 0.60 μg in edge length. This emulsion was optimally sensitized by the addition of a colloidal suspension of aurous sulfide (18.4 mg/Ag-M) and heat ramped up to 60° C., during which time blue sensitizing dye BSD-2, (414 mg/Ag-M), 1-(3-acetamidophenyl)-5-mercaptotetrazole (93 mg/Ag-M) and potassium bromide (0.5 M %) were added. In addition, iridium dopant $K_2IrCl_6$ (7.4 μg/Ag-M) was added during the sensitization process.

Couplers C-1 or C-2 were coated as the cyan imaging coupler in the red sensitive record, RL. The $4^{th}$ sensitized layer, IR, was made sensitive to light in the spectral region between the red and green spectral sensitizing dyes by the presence of the short red sensitizing dye BSD-2, emulsion Red-EM-2. This emulsion was combined with either coupler C-3, C-4, or C-5 to generate the various multilayer combinations of photographic examples. This element has the following spectral sensitivities as given in Table 18 below:

TABLE 18

Spectral Sensitivities of the Photographic Element

| Emulsion | Sensitizing Dye | Peak Spectral Sensitivity |
|---|---|---|
| Blue EM-2 | BSD-4 | 473 nm |
| Green EM-1 | GSD-1 | 550 nm |
| Red EM-1 | RSD-1 | 695 nm |
| Blue EM-1 | BSD-2 | 425 nm |

In addition, the layer order of the element was altered by moving the $4^{th}$ sensitized layer to the uppermost emulsion layer as shown in Table 19 below:

TABLE 19

| Inventive Structure #2 |
|---|
| Overcoat |
| UV absorbing layer |
| 4th Sensitized Layer containing an IR Dye forming Coupler |
| Interlayer |
| Red light sensitive layer |
| Interlayer |
| Green light sensitive layer |
| Interlayer |
| Blue light sensitive layer |
| Support |

The location of the $4^{th}$ sensitized layer in the multilayer structure is not critical to the practice of the invention. Placement of the layer in the middle is also possible.

Higher resolution metadata images are obtained if the $4^{th}$ sensitized layer is placed as the topmost sensitized record due to reduced light scattering as the emulsion is scan exposed. Inclusion of an antihalation layer as the undermost layer further improves the resolution of the system. Antihalation layers are well known in the photographic industry and are generally comprised of either finely divided silver metal particles (known as grey gel) or as mixtures of solid particle dye dispersions.

Results of the analysis of the elements formed in the example were similar to those described in Example 2 as only the spectral sensitization of the FS layer of the element was altered.

The invention has been described in detail with particular reference to the preferred embodiments thereof, but it will be understood that variations and modifications can be effected within the spirit and scope of the invention.

BSD-4
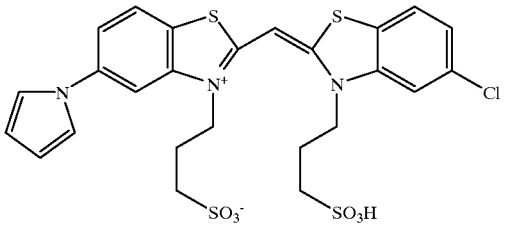
GSD-1
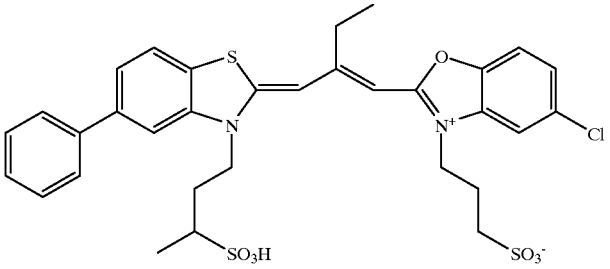
RSD-1
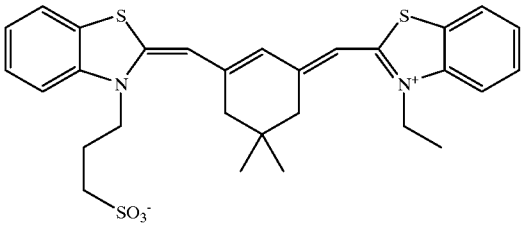
Y-1
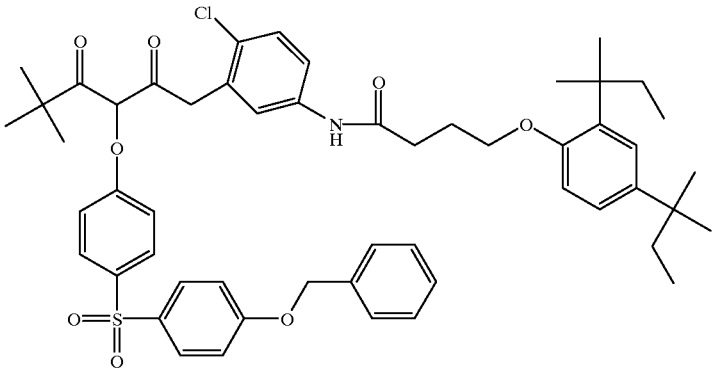
M-2
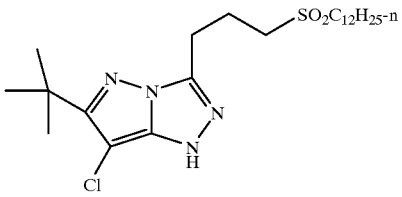
C-1
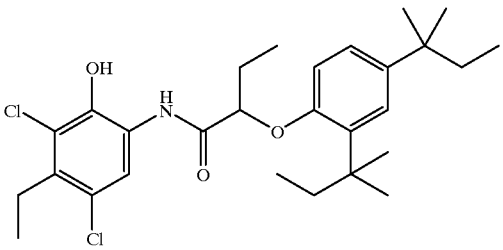

-continued
ST-6
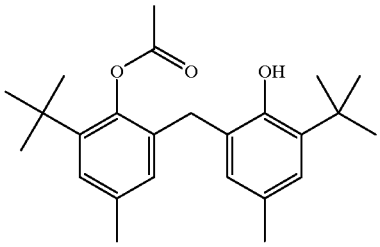
ST-8
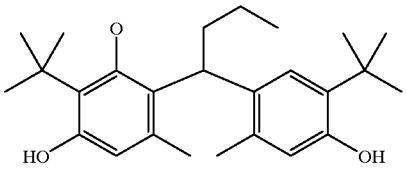
ST-16
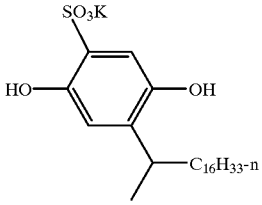
ST-21
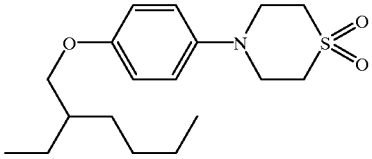
ST-22
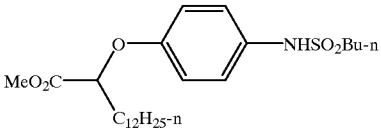
DYE-1
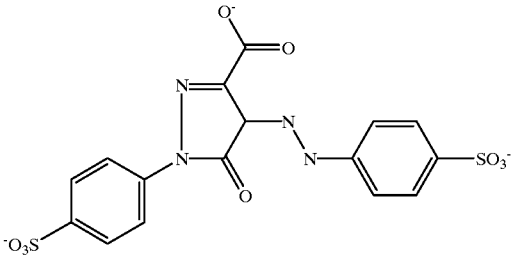
DYE-2
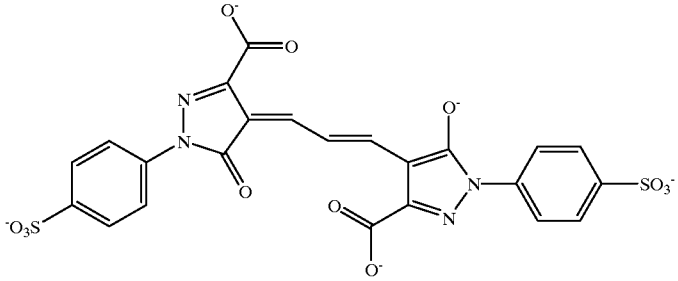
DYE-3
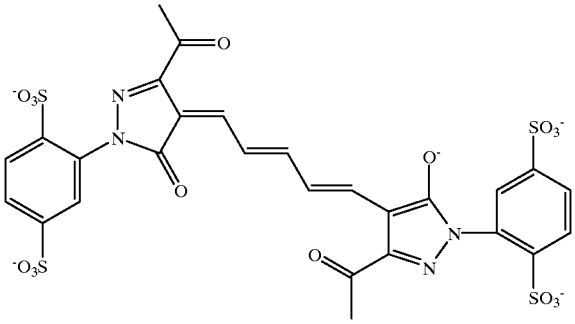

-continued
UV-1
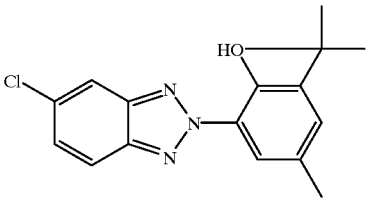
UV-2
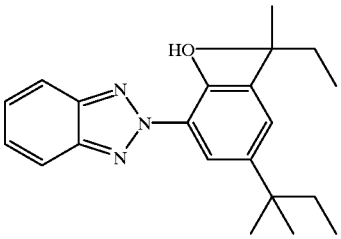
SF-1
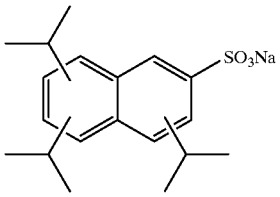
SF-2
$CF_3(CF_2)_7SO_3Na$
SF-12
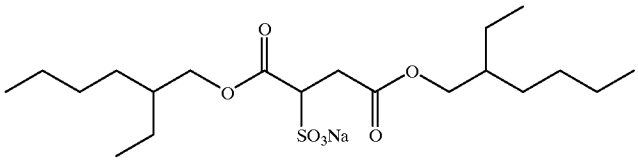
C-2
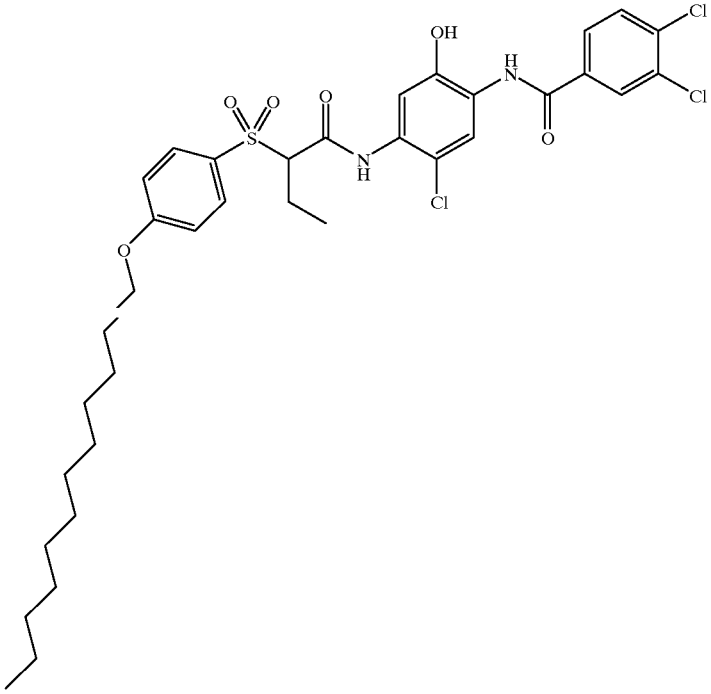
C-3
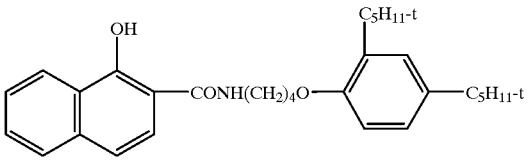

-continued
C-4
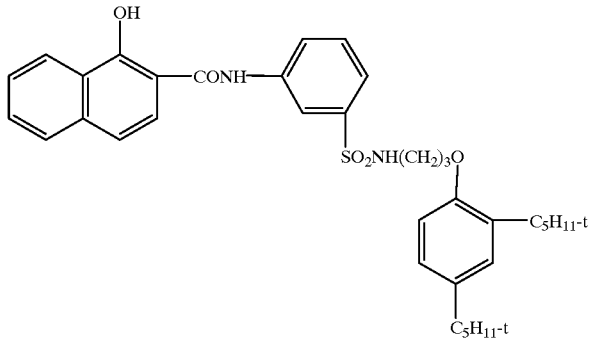
C-5
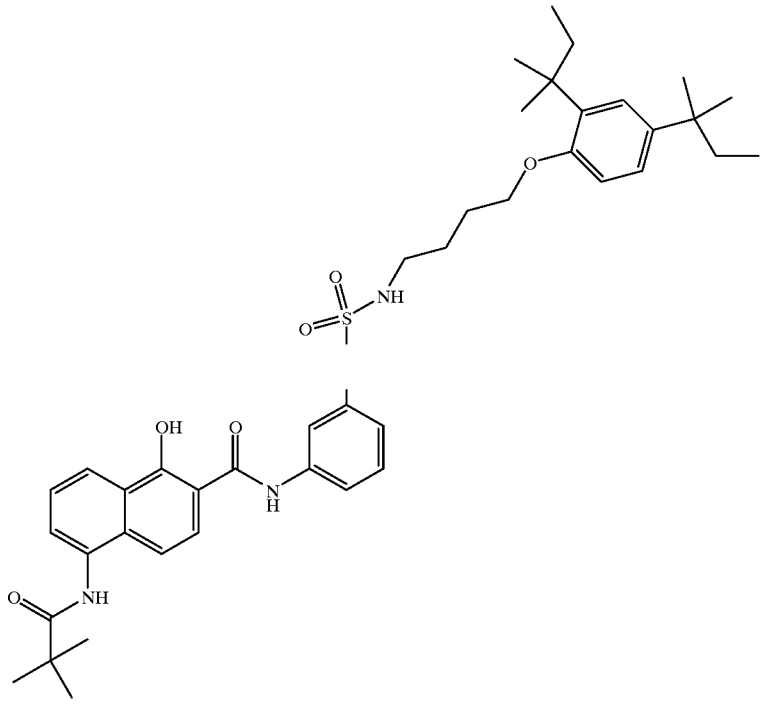
BSD-2
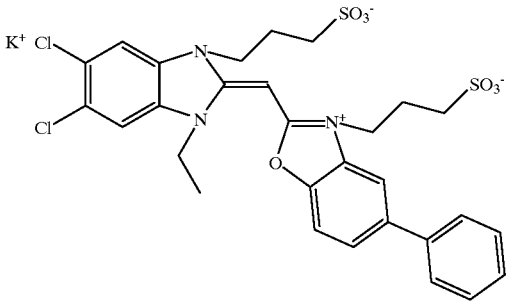

-continued
GSD-2
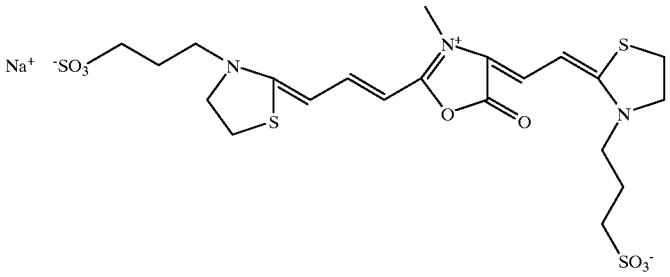
IRSD-1
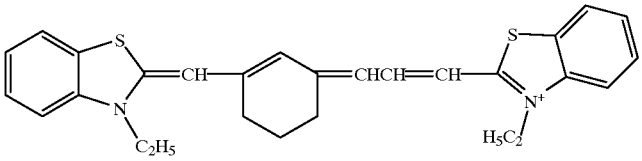
IRSD-2
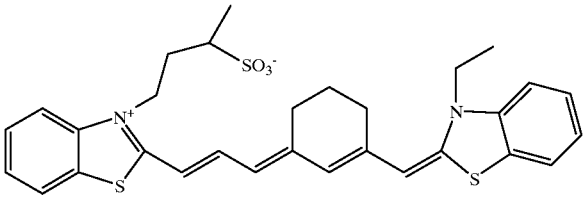
IRSD-3
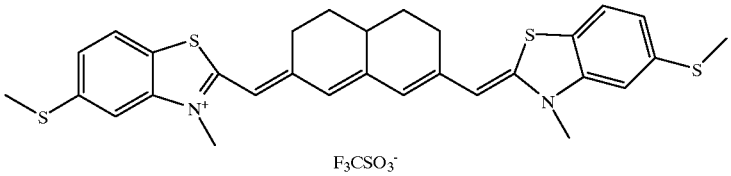
IRSD-4
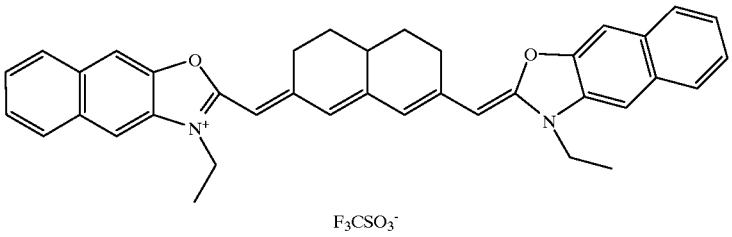
Dye-4
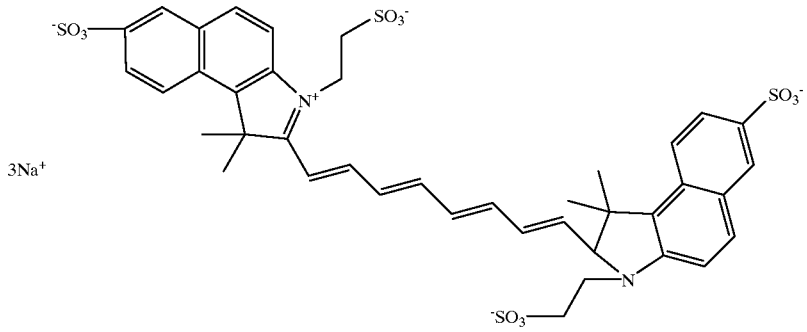

-continued

Dye-5

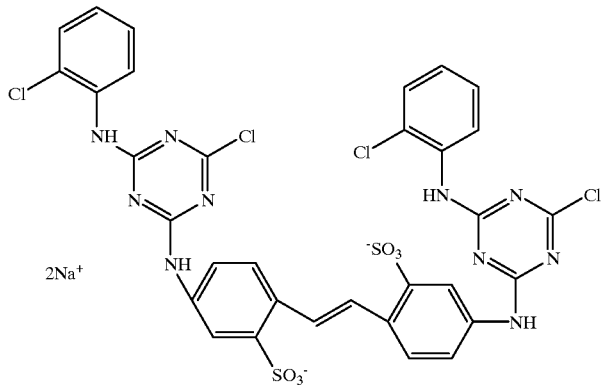

Parts List:

1. Metadata source
2. A/D converter
3. Digital compression
4. Digital encoder
5. Digital printer driver circuitry
6. R, G, B Values from digital image tile
7. Digital encoder
8. 4-channel optical multiplexer
9. Digital printer
10. Color print with metadata overlay
11. Metadata image sensor
12. Lens
13. Filter array
14. CMOS or CCD Sensor
15. Infrared lamp
16. Infrared light
17. Speaker
18. Image sensor electronics
19. Memory storage
20. Metadata image processor
21. Metadata decoder circuit
22. Metadata decompression circuit
23. D/A converter
24. Amplifier

What is claimed is:

1. A color negative photographic element comprising a support, upon which is coated a blue sensitive silver halide layer containing a yellow dye forming coupler, a green sensitive silver halide layer containing a magenta dye forming coupler, a red sensitive silver halide layer containing a cyan dye forming coupler, and a $4^{th}$ sensitized layer containing an infrared dye forming coupler and wherein the dye formed by the infrared dye forming coupler has a λmax greater than 680 nm and wherein the density of the absorption band of the characteristic vector of the cyan dye, normalized to 1.0 density, is less than 0.4 at 700 nm.

2. The element of claim 1 wherein the density of the absorption band of the characteristic vector of the cyan dye, normalized to 1.0 density, is less than 0.35 at 700 mn.

3. The element of claim 1 wherein the density of the absorption band of the characteristic vector of the cyan dye, normalized to 1.0 density, is less than 0.2 at 700 nm.

4. The element of claim 1 wherein the wavelength of maximum spectral sensitivity for the silver halide emulsions in the at least four imaging layers are separated by at least 30 unm.

5. The element of claim 1 wherein the fourth light sensitive silver halide emulsion layer is located below all of the other light sensitive layers.

6. The element of claim 1 wherein the fourth light sensitive layer is located above all of the other light sensitive layers.

7. The element of claim 1 wherein the fourth light sensitive layer has a maximum spectral sensitivity that is greater than 700 nm.

8. The element of claim 1 wherein the fourth light sensitive layer has a maximum spectral sensitivity that is greater than 720 nm.

9. The element of claim 1 wherein the fourth light sensitive layer has a maximum spectral sensitivity of from 590 to 640 nm.

10. The element of claim 1 wherein the fourth light sensitive layer has a maximum spectral sensitivity of from 400 to 460 nm.

11. The element of claim 1 additionally comprising a reflective support.

12. The element of claim 1 additionally comprising a transparent support.

13. The element of claim 1 packaged with instructions to process using a color negative print developing process.

14. The element of claim 1 wherein the element is a direct-view element.

15. A process for forming an image in an element as described in claim 1 after the element has been imagewise exposed to light comprising contacting the element with a color-developing compound.

16. The process of claim 13 in which the developer is a p-phenylenediamine compound.

17. The element of claim 1 wherein the emulsions in the element are comprised of 3-dimensional silver chloride emulsions, which are predominantly greater than 95 M % silver chloride.

18. The element of claim 1 wherein the emulsions are predominantly monodisperse.

19. The element of claim 1 wherein the grain sizes of the emulsions are between 0.05μ and 0.95μ in cubic edge length.

20. The element of claim 1 wherein at least one of the emulsions of the element contains iridium.

21. The element of claim 1 wherein the emulsions are sulfur and gold sensitized.

* * * * *